US009945629B2

(12) United States Patent
Osborne

(10) Patent No.: US 9,945,629 B2
(45) Date of Patent: Apr. 17, 2018

(54) COLLAPSIBLE PISTOL

(71) Applicant: William S. Osborne, Camas, WA (US)

(72) Inventor: William S. Osborne, Camas, WA (US)

( * ) Notice: Subject to any disclaimer, the term of this patent is extended or adjusted under 35 U.S.C. 154(b) by 0 days.

(21) Appl. No.: 15/039,000

(22) PCT Filed: Nov. 28, 2014

(86) PCT No.: PCT/US2014/067821
§ 371 (c)(1),
(2) Date: May 24, 2016

(87) PCT Pub. No.: WO2015/088794
PCT Pub. Date: Jun. 18, 2015

(65) Prior Publication Data

US 2016/0377361 A1 Dec. 29, 2016

Related U.S. Application Data

(60) Provisional application No. 61/913,642, filed on Dec. 9, 2013.

(51) Int. Cl.

| | |
|---|---|
| ***F41A 11/04*** | (2006.01) |
| ***F41C 3/00*** | (2006.01) |
| ***F41A 9/17*** | (2006.01) |
| ***F41A 9/60*** | (2006.01) |
| ***F41A 9/78*** | (2006.01) |
| ***F41C 9/02*** | (2006.01) |

(52) U.S. Cl.
CPC ..... *F41A 11/04* (2013.01); *F41A 9/17* (2013.01); *F41A 9/60* (2013.01); *F41A 9/78* (2013.01); *F41C 3/00* (2013.01); *F41C 9/02* (2013.01)

(58) Field of Classification Search
CPC ..... F41A 9/17; F41A 9/60; F41A 9/78; F41A 11/04; F41C 3/00; F41C 9/02
See application file for complete search history.

(56) References Cited

U.S. PATENT DOCUMENTS 1,059,405 A * 4/1913 Sprague ..... F41A 3/58 42/8
1,454,454 A * 5/1923 Rosier ..... F41A 11/04 42/106

(Continued)

FOREIGN PATENT DOCUMENTS

DE 2428434 12/1975

OTHER PUBLICATIONS

International Search Report for PCT/US2014/067821 (dated Apr. 14, 2015).
Written Opinion for PCT/US2014/067821 (dated Apr. 14, 2015).

*Primary Examiner* — Stephen Johnson
*Assistant Examiner* — Joshua T Semick
(74) *Attorney, Agent, or Firm* — Klarquist Sparkman, LLP

(57) ABSTRACT

A collapsible pistol features enhanced safety, ease of use, and improved performance as compared to prior designs. The pistol is easily reconfigured from an open, ready-to-fire position to a closed or collapsed position that makes the pistol quite compact, safe, and readily concealable. The overall design of the pistol is such that the manipulation of the pistol into and out of the open, ready-to-fire position can be accomplished with a user having relatively small hands and/or relatively low grip strength.

8 Claims, 34 Drawing Sheets

(56) References Cited

U.S. PATENT DOCUMENTS 3,026,643 A * 3/1962 Goldfarb ..... F41C 3/06 42/1.09
3,091,370 A * 5/1963 Weiner ..... F41A 11/04 222/79
3,209,480 A * 10/1965 Mittelsteadt ..... F41A 17/74 42/41
3,267,600 A * 8/1966 Ryan ..... F41C 3/06 124/2
3,561,149 A * 2/1971 Center ..... F41A 3/58 42/41
3,979,850 A * 9/1976 Schiessl ..... F41A 11/04 42/1.15
4,016,800 A * 4/1977 Rusbach ..... F41A 11/04 403/109.5
4,128,957 A 12/1978 Lee
4,625,621 A * 12/1986 Warin ..... F41C 9/02 42/1.09
4,825,744 A 5/1989 Glock
5,791,326 A * 8/1998 Brown ..... F41B 11/642 124/66
5,944,006 A * 8/1999 Moore ..... F41B 11/642 124/65
6,234,058 B1 * 5/2001 Morgado ..... F41A 3/04 102/376
7,739,821 B1 * 6/2010 Hamme ..... F41A 3/06 42/2
7,941,954 B2 * 5/2011 Carr ..... F41C 23/10 42/36
8,006,425 B2 * 8/2011 Burt ..... F41A 3/66 42/1.09
8,196,328 B2 * 6/2012 Simpkins ..... B25F 1/04 42/114
8,910,561 B2 * 12/2014 Plaxats Oller ..... F41A 5/16 89/139
9,021,734 B2 * 5/2015 Voigt ..... F41C 23/14 42/75.04
9,273,927 B2 * 3/2016 Bondhus ..... F41C 3/00
9,291,411 B2 * 3/2016 Zonshine ..... F41A 3/58
D756,478 S * 5/2016 Osborne ..... D22/104
2010/0242331 A1 9/2010 Carr et al.
2013/0192452 A1 8/2013 Oller

* cited by examiner

COLLAPSIBLE PISTOL

CROSS REFERENCE TO RELATED APPLICATIONS

This is the U.S. National Stage of International Application No. PCT/US2014/067821, filed Nov. 28, 2014, which was published in English under PCT Article 21(2), which in turn claims the benefit of U.S. Provisional Application No. 61/913,642, filed Dec. 9, 2013. The provisional application is incorporated herein in its entirety.

BACKGROUND INFORMATION

This invention relates to a firearm that is held and fired with one hand. Such firearms are often referred to as handguns or pistols.

A pistol formed in accordance with this invention features enhanced safety, ease of use, and superior performance over prior designs. The pistol opens swiftly into the ready-to-fire position, which may be accomplished with a single hand. The overall design of the pistol is such that the manipulation of the pistol into and out of the open, ready-to-fire position can be accomplished with a user having relatively small hands and/or relatively low grip strength. Exemplary advantageous aspects of the invention include:

(a) a pistol that is easily reconfigured from an open, ready-to-fire position to a closed or collapsed position that makes the pistol quite compact, safe, and readily concealable;

(b) a safety interlock that disables operation of the pistol's firing mechanisms as soon as the pistol is released from the ready-to-fire position for reconfiguration in the closed position;

(c) a magazine that is integrated with the pistol to extend along and above the length of the barrel;

(d) locking features that prevent access to the pistol or magazine when the pistol is in the closed position;

(e) a breech lock system to keep the breech closed after firing until the barrel has fully recoiled, thereby to reduce the recoil reaction felt by the user and to maintain the internal cleanliness of the pistol;

(f) a hammer and firing pin assembly that, among other features, enhances the compactness of the pistol configuration;

(g) a frame that encloses substantially all of the slide assembly to prevent injury from the high-velocity motion of that assembly that occurs during recoil and return;

(h) a system for transporting cartridges from the magazine above the barrel to the breech end of the barrel;

(i) a side-loading magazine that significantly reduces, as compared to prior magazines, the amount of force required for fully loading the magazine with cartridges;

(j) an indexing system for precisely moving cartridges through the magazine during operation of the pistol; and (k) a cartridge shell ejector system for safely ejecting spent cartridge shells downwardly through a cavity in the handle of the pistol.

BRIEF DESCRIPTION OF THE DRAWINGS

FIG. 19B is in slight perspective angle.

DETAILED DESCRIPTION OF PREFERRED EMBODIMENTS

Generally

Figure 1:
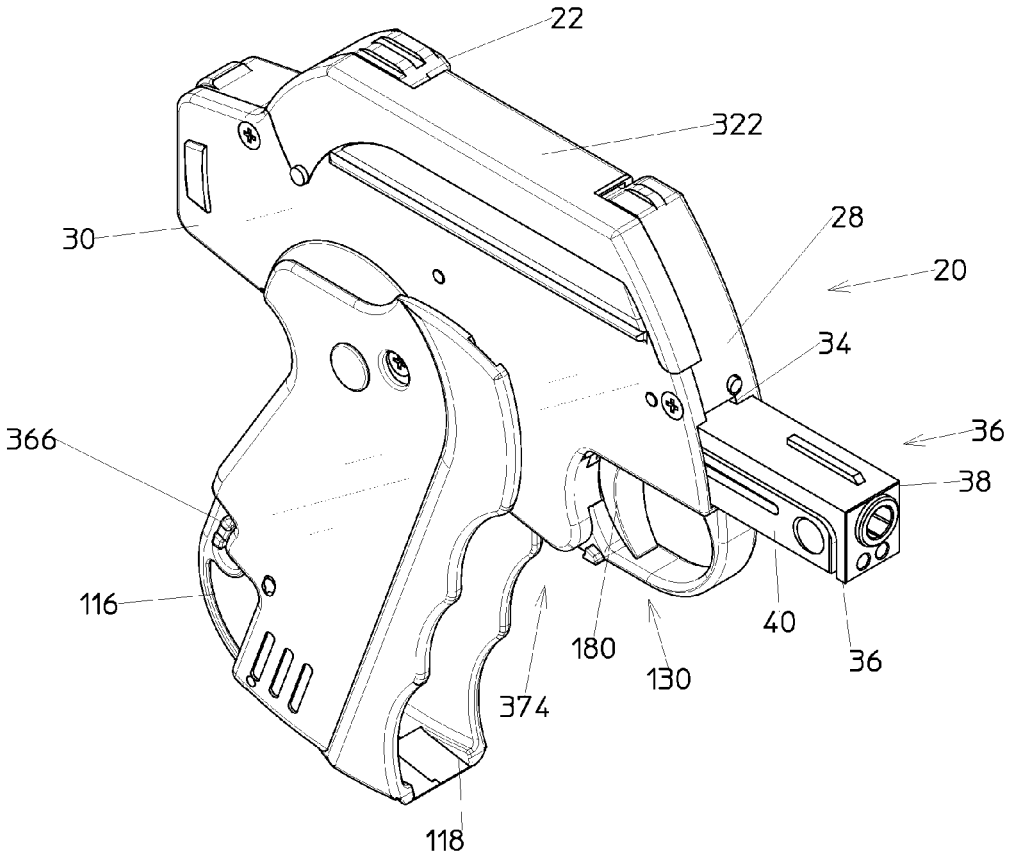
FIG. 1 is a perspective view of one preferred embodiment of a collapsible pistol formed in accordance with the present invention showing the pistol in the ready-to-fire or open position.

A pistol formed in accordance with this invention features enhanced safety, ease of use, and improved performance as compared to prior designs. The pistol opens swiftly into the ready-to-fire position, which opening may be accomplished with a single hand. The overall design of the pistol is such that the manipulation of the pistol into and out of the open, ready-to-fire position can be accomplished with a user having relatively small hands and/or relatively low grip strength.

To facilitate the description of the invention, reference is first made to FIGS. 6A-6F, which are respective elevation views of the top; back; right side; front; left side; and bottom of the pistol in the open or ready-to-fire position. These directional terms "top," "back," "front," etc., will be frequently used throughout this description in conformance with the orientations illustrated in FIGS. 6A-6F, unless otherwise stated or obvious from the context.

With reference to all of the figures and particularly to FIGS. 1-4, 16-18 and 20-25, the pistol 20 includes a frame 22 that comprises a back plate 24 (FIG. 3) with a generally flat outer surface 26. Around much of the edge of the back plate 24, a sidewall 28 extends inwardly of the pistol 20 to define a space within which many of the pistol's internal parts are enclosed. A generally flat cover 30 (FIG. 1) is fastened to the innermost edges of the sidewall 28 to substantially complete the frame 22 and define a housing or encasement for the internal parts.

Slide Assembly

As will be described, several features are formed on the interior of the frame 22 that, in addition to cutouts and apertures, are used for assembly and operation of the pistol components. For instance, a muzzle aperture 34 is formed through the frame sidewall 28 on the front or forward end of the pistol 20. A slide assembly 36 fits through the muzzle aperture 34 (FIG. 1). The slide assembly 36 generally comprises a barrel 38 and associated bolt 40. The barrel 38 and bolt 40 reciprocate relative to the frame 22 as described more fully below.

As shown in FIGS. 12A-12G, and other figures, the barrel 38 includes an elongated body 42 having a generally rectangular cross section. Extending through the length of the barrel is a cylindrical bore that has a muzzle 44 at one end and a breech 46 at the other. In one embodiment, the barrel body 42 and bore are integrally formed, although it is contemplated that the barrel could otherwise comprise a separate cylindrical barrel affixed within the barrel body 42.

The barrel body 42 (FIG. 12F, and FIGS. 26A-26C) includes a downwardly depending lug 48 at the front or muzzle end (that is, the end near the muzzle 44), and a downwardly depending leg 50 at the opposite, rear or breech end. A pair of spring guides extend across the space between the lug 48 and leg 50. The guides are rods forming a main spring guide 52 and a bolt spring guide 54 (FIG. 12F). The guides are located adjacent to and parallel to one another with opposing ends attached to the respective lug 48 and leg 50 of the barrel body. A main spring 56 is around the main spring guide rod 52. A bolt spring 58 is around the bolt spring guide 54. In the drawings, many of the elongated, coiled springs, such as main spring 56 and bolt spring 58 are illustrated with mid-portions omitted for illustrative purposes (to reveal guide rods, for instance). It is understood, however, that the springs so illustrated are continuous between the depicted opposite ends.

Figure 23A:
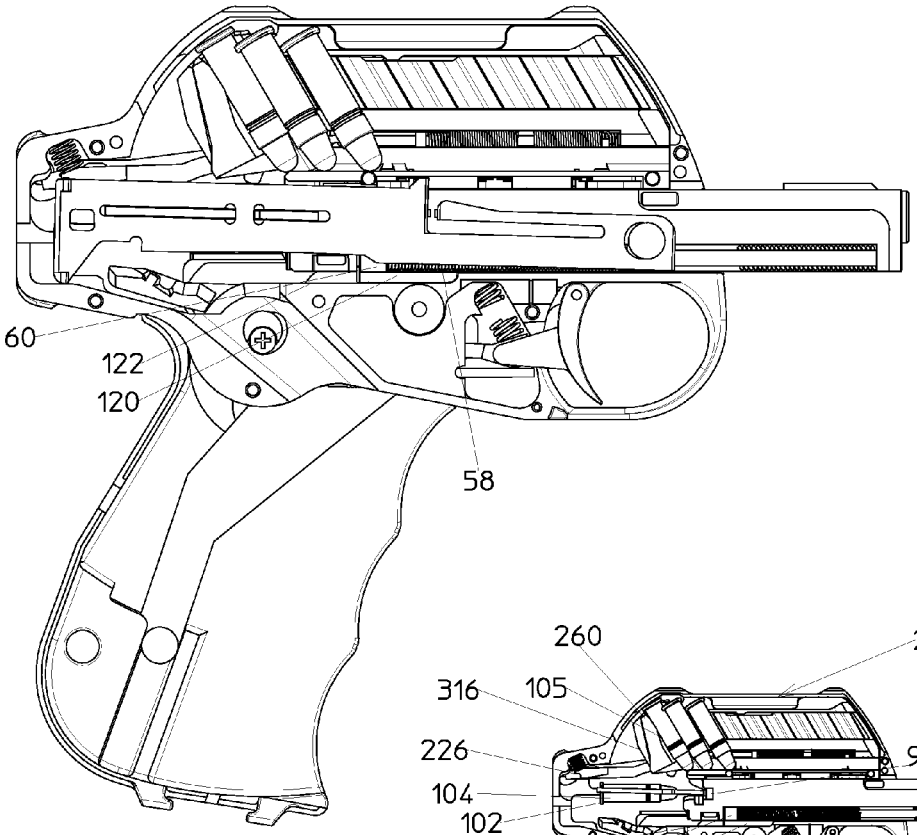
FIGS. 23A-23B are right side views of the pistol with covering removed to show the firing operation of the pistol, here showing the barrel extended and the recoiled bolt latched in an open breech state of the pistol as the spent, extracted cartridge shell is to be ejected. The bolt component is omitted in FIG. 23B.
Figure 23B:
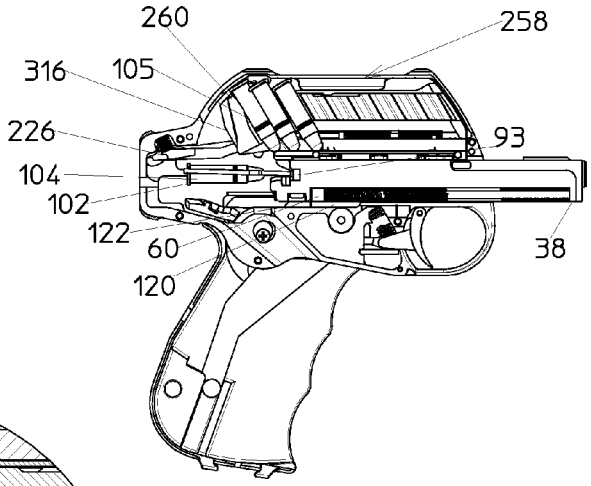

The muzzle end of the main spring 56 abuts the lug 48. The opposite, breech end of the main spring 56 abuts a spring stop 60 (FIGS. 23A-23B). The spring stop 60 protrudes upwardly from the rearward end of an integrally formed guide block 120 that rests on an internal guide platform 122 formed in the frame 22. The guide block 120 thus fits between the guide platform and the underside of the slide assembly 36 and is described more below. The spring stop 60 protrudes into the path of the pair of the spring guides 52, 54 and associated springs. The two spring guides 52, 54 (FIG. 12F) extend through correspondingly sized openings in the stop 60, but the breech end of the main spring 56 is seated in the stop 60. Accordingly, when the barrel 38 moves relative to the spring stop 60, such as during recoil when the barrel muzzle 44 approaches the stationary stop 60, the main spring guide 52 will pass through the stop and the main spring 56 will be compressed between the stop 60 and lug 48 of the barrel.

Similarly, the breech end of the bolt spring 58 is seated in the stop 60. The other, muzzle end of the bolt spring 58 is connected to move with the bolt 40, as will be described after the following description of the bolt and firing pin assembly.

Bolt; Firing Pin

Figure 12A:
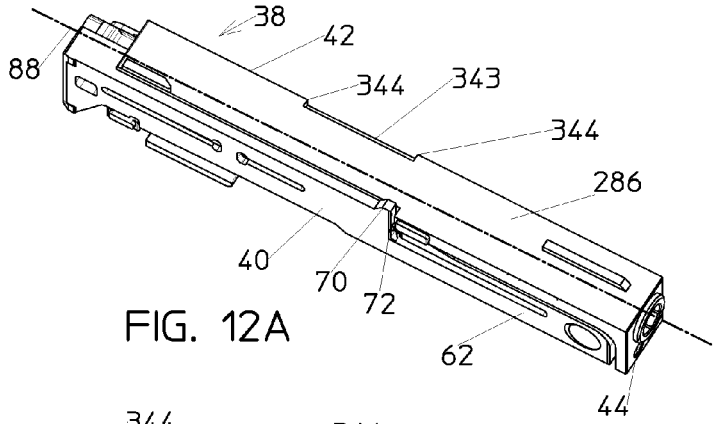
FIGS. 12A-12G are views of the slide assembly of the pistol.
Figure 12B:
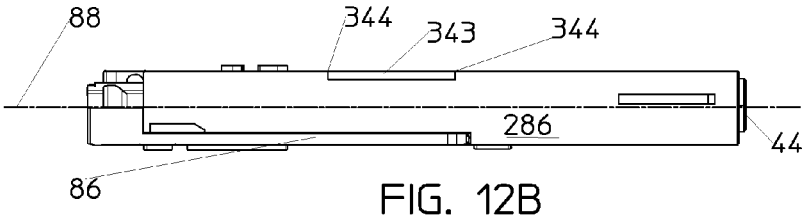
Figure 12C:
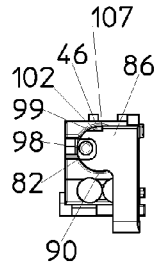
Figure 12D:
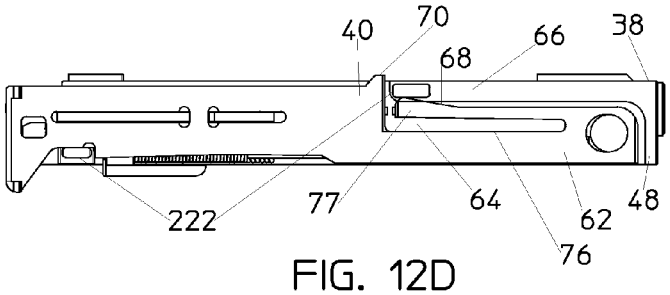
Figure 12E:
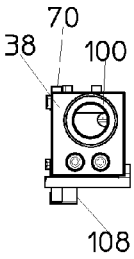
Figure 12F:
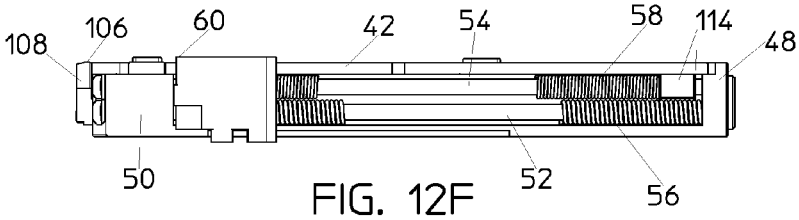
Figure 12G:
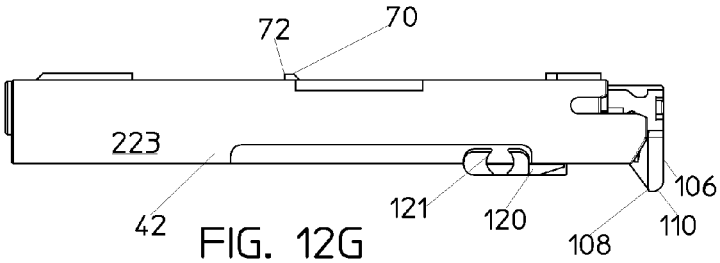
Figure 12H:
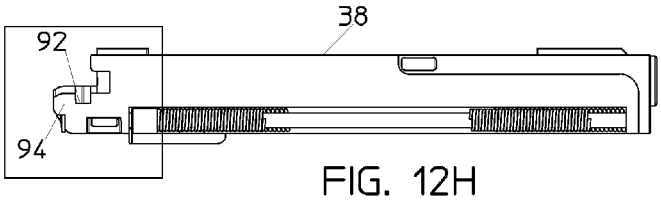
FIGS. 12H-12P are detail views of the bolt, shell extractor and firing pin components described herein.
Figure 12I:
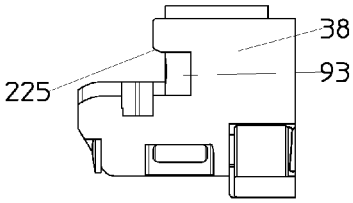
Figure 12J:
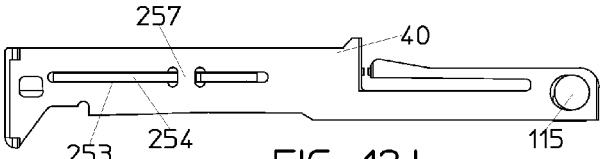
Figure 12K:
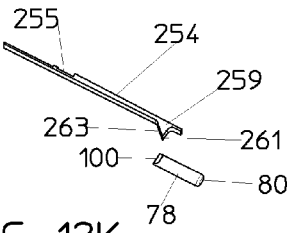
Figure 12L:
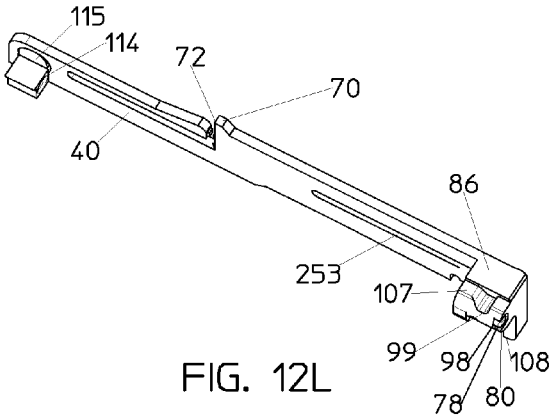
Figure 12M:
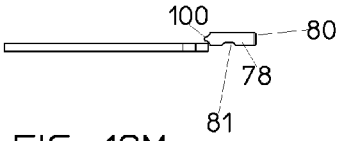
Figure 12N:
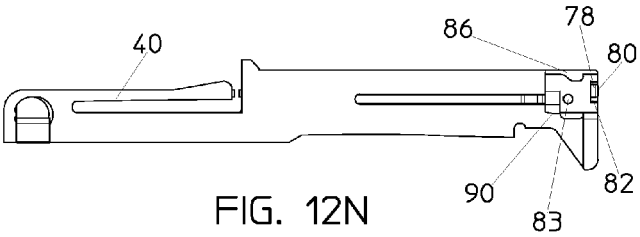
Figure 12O:
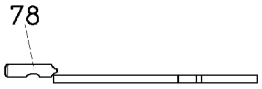
Figure 12P:
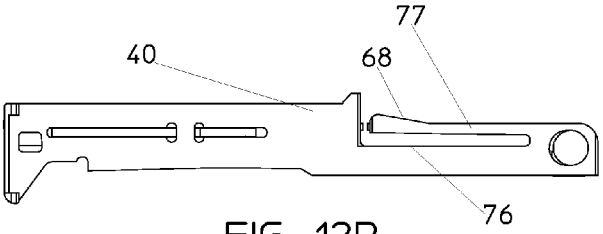
Figure 13A:
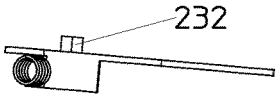
FIGS. 13A-13H are views of a latch mechanism for securing the bolt and extracting a spent cartridge during the automatic reloading sequence of operation of the pistol.
Figure 13B:
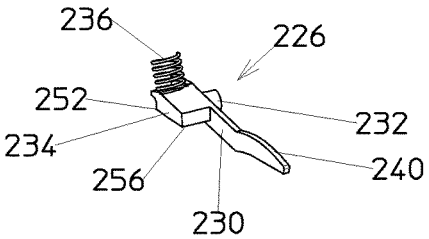
Figure 13C:
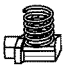
Figure 13D:
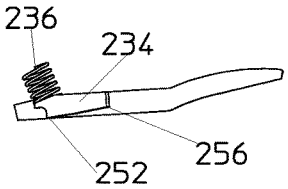
Figure 13E:
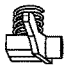
Figure 13F:
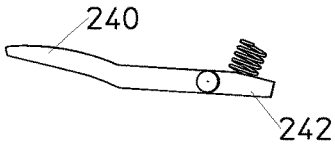
Figure 13G:
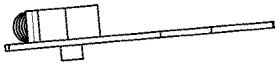
Figure 13H:
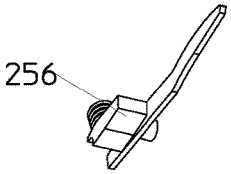

As shown in FIGS. 12A-12P, the bolt 40 is an elongate, blade-like member that is mounted adjacent to the right side of the barrel body 42 and movable relative to the barrel. When the slide assembly 36 (generally comprising the barrel 38 and bolt 40) is in the ready-to-fire position, a leading end 62 of the bolt fits against the face 64 of the barrel body 42 beneath a generally L-shaped protrusion 66 extending outwardly from that face 64. That protrusion 66 extends from the muzzle end of the barrel, where it defines part of the lug 48, toward the breech end of the barrel, partway along the length of the barrel. An L-shaped slit 76 (FIGS. 12D, 12P) is formed through the leading end 62 of the bolt 40 to define an integral, elongated cantilever spring 77 that extends along the portion of the bolt that fits beneath the protrusion 66 of the barrel body. The free end of the spring 77 has a tapered upper surface 68 that engages the rearward underside of the protrusion 66 to thereby provide a guide for motion of the bolt 40 relative to the barrel 38 during operation as will be described.

With continued reference to FIGS. 12A-12P, the portion of the bolt rearward of and spaced from the free end of the spring 77 includes a top flange 70 that protrudes above the barrel 38. The forward end of the top flange is shaped to present a generally vertical, shoulder 72 (FIGS. 12D and 12L). Preferably, the edge of the shoulder 72 facing the bolt is slightly chamfered.

The breech end of the bolt 40 is formed to have a breech block 86 (FIGS. 12C and 12L) that extends generally perpendicular to the remainder of the bolt and across the long central axis 88 of the barrel bore. The bottom 90 of the breech block 86 (FIGS. 12C and 12N) seats in a linear breech groove 92 (FIGS. 12H and 26B) that is formed in an upper facing side of a foot 94 that is a rearward extension of the above-described leg 50 of the barrel 38. Farther rearward of the breech groove 92, the upper surface of the foot 94 is curved into a concave guide chute 96 that is centered on the bore axis 88 and guides cartridges into the breech 46 of the barrel bore when the breech block 86 is displaced therefrom as will be described.

With the bottom 90 of the breech block 86 seated in the groove 92, the breech is characterized as "closed" in that the breech block 86 is seated against the breech end of the barrel with only a small gap between the block 86 and barrel for receiving in the gap the rim of a cartridge that is chambered in the breech 46. As used here, the term "chambered cartridge" means a cartridge that is fully inserted into the breech 46 of the barrel 38. A portion of the rim of a chambered cartridge will be exposed to the tip 100 of a firing pin 78 that is retained within a firing aperture 98 that is formed through the breech block 86 of the bolt (FIG. 12L). The firing pin 78 includes an axial groove 81 on its underside (FIG. 12M) through which groove fits a transverse pin 83 to retain the pin in the aperture 98 while allowing the pin 78 to reciprocate slightly, longitudinally within the aperture (FIG. 12N). The opposite end or head 80 of the firing pin 78 is exposed within an enlarged, counter-bored end 82 of the firing aperture 98. The head 80 is struck by a hammer 84, and the impulse delivered by the hammer is applied by the tip 100 of the pin to the rim 102 of a chambered cartridge to ignite the primer of the cartridge and fire the pistol. The tip 100 is shaped for igniting the primer of either rim-fire or center-fire cartridges. (FIGS. 12K-12M)

The breech block 86 upper side includes a laterally extending catch groove 99 (FIGS. 12C and 12L) that serves as part of the below-described assembly for temporarily latching the bolt 40 in position to enable a spent cartridge to be extracted from the breech, as another cartridge is readied for chambering in the breech.

The end of the bolt 40 at the breech block 86 also includes a downwardly depending arm 106 that terminates in a sled 108 (FIGS. 12E and 12G). The rearward or breech-facing edge 110 of the sled 108 is rounded slightly (FIG. 12G). As the slide assembly 36 is retracted (such as during recoil), the sled 108 engages a camming feature 112 present on the inner surface of the frame sidewall 28 near the breech (FIGS. 22A-22B), and the camming feature 112 has the effect of slightly lifting the breech end of the bolt 40, relative to the barrel, as the bolt arrives in the full recoil position, as will be described.

As noted earlier, the muzzle end of the bolt spring 58 is connected to move with the bolt 40. In this regard, a stop sleeve 114 is mounted to extend inwardly from the leading end 62 of the bolt (FIGS. 12F and 12L) and surround the bolt spring guide 54. That end of the bolt spring 58 seats against the stop sleeve 114 so that whenever the bolt 40 is moved rearwardly or forwardly relative to the barrel 38, the bolt spring 58 will respectively compress or expand as the stop sleeve 114 moves toward and away from the spring stop 60 at the opposite end of the spring guide 54, as described more later. The stop sleeve 114 is carried on a disc 115 that fits rotatably within a correspondingly shaped hole in the leading end of the bolt 62.

Collapsible

Before turning to the firing operation of the pistol, this description proceeds with the primary components that provide a pistol that is easily reconfigured between an open, ready-to-fire position to a closed and collapsed position to make the pistol quite compact, safe, and readily concealable.

Figure 2:
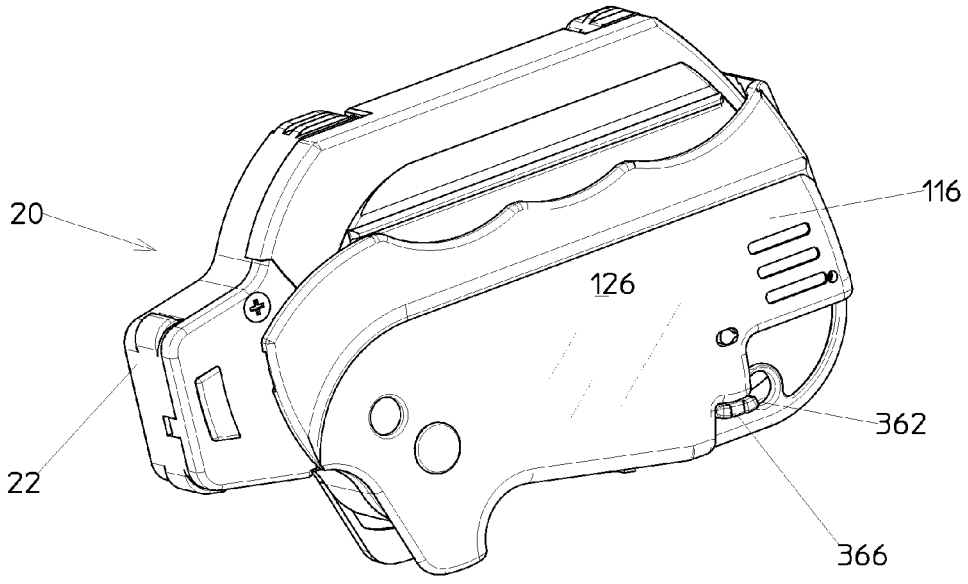
FIG. 2 is a perspective view of the pistol of FIG. 1 showing the pistol in the collapsed or closed position.
Figure 3:
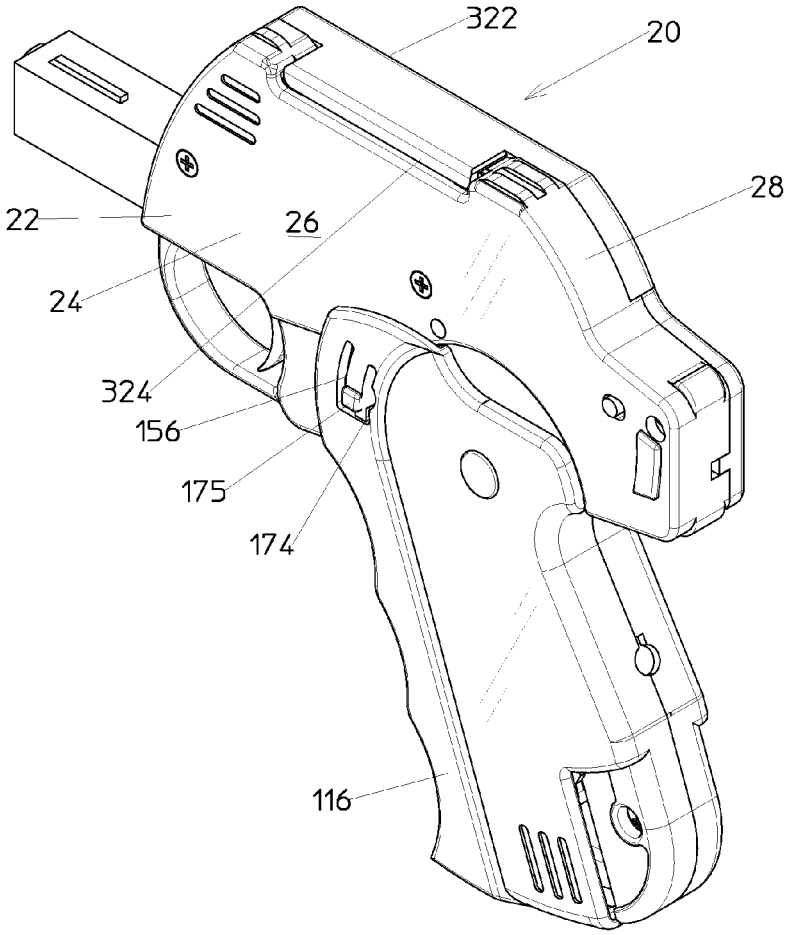
FIG. 3 is another perspective view of the collapsible pistol formed in accordance with the present invention showing the pistol in the ready-to-fire position.
Figure 4:
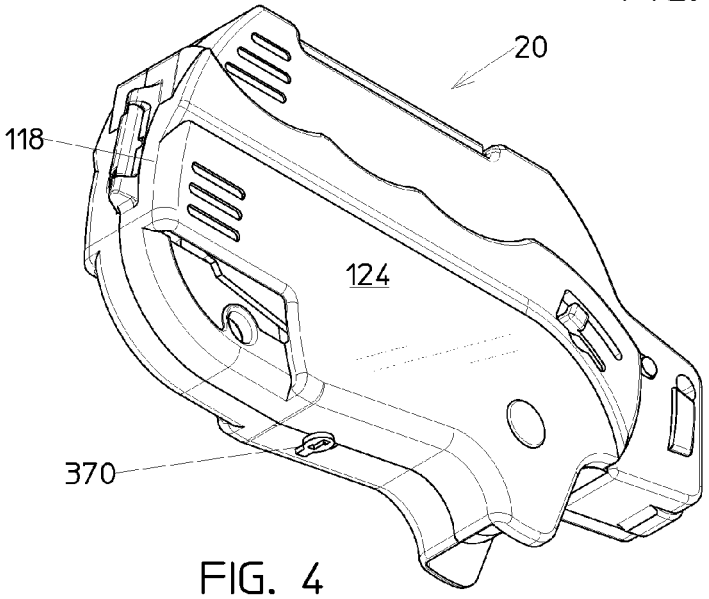
FIG. 4 is another perspective view of the pistol of FIG. 1 showing the pistol in the collapsed or closed position.

With reference to FIGS. 1-4, the pistol 20 includes a partially hollow handle 116 that is pivotally attached to the frame 22. The handle 116 pivots from a ready-to-fire position (FIGS. 1 and 3) to a compact, closed position (FIGS. 2 and 4). The pistol can only be fired when it is locked into the ready-to-fire position. Firing mechanisms are rendered inoperative as soon as the pistol is moved out of that position.

The handle 116 of the pistol is linked to the slide assembly 36, which is mounted to the frame to move with the pivoting handle. Specifically, as the handle 116 is pivoted from the ready-to-fire position to the closed position, the slide assembly 36 is retracted such that the muzzle end of that assembly moves through the muzzle aperture 34 completely into the frame 22. In the closed position, the hollow handle completely encloses the trigger assembly 130 and associated mechanisms of the pistol as well as the muzzle aperture 34. The butt 118 of the handle covers the aperture 34 as well as the muzzle end of the barrel that is just inside the aperture. As the handle 116 is pivoted from the closed to the ready-to-fire position, the slide assembly 36, to which the handle is linked, will extend toward and partly through the muzzle aperture 34.

Figure 10:
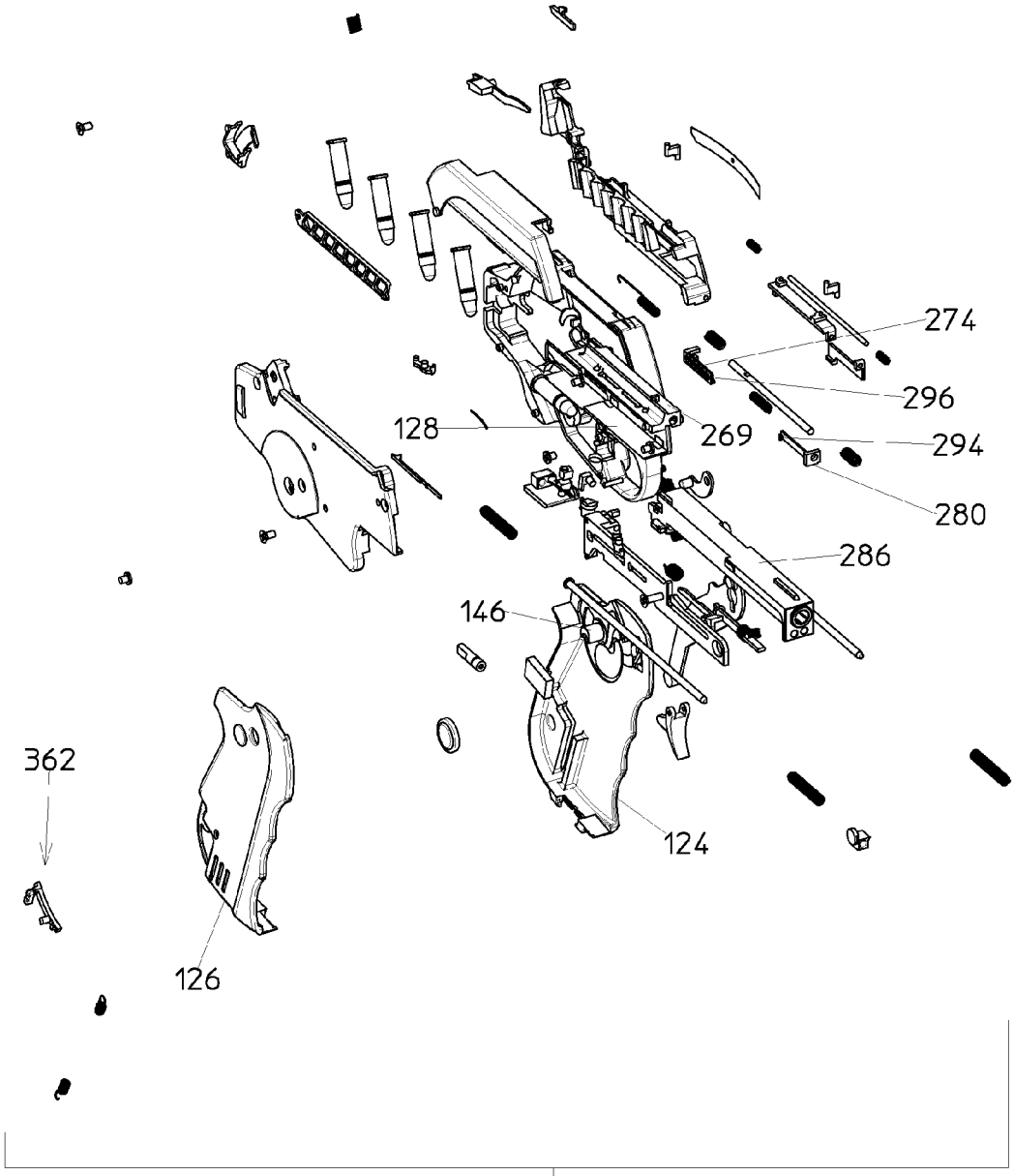
FIG. 10 is an exploded view of the pistol.
Figure 16:
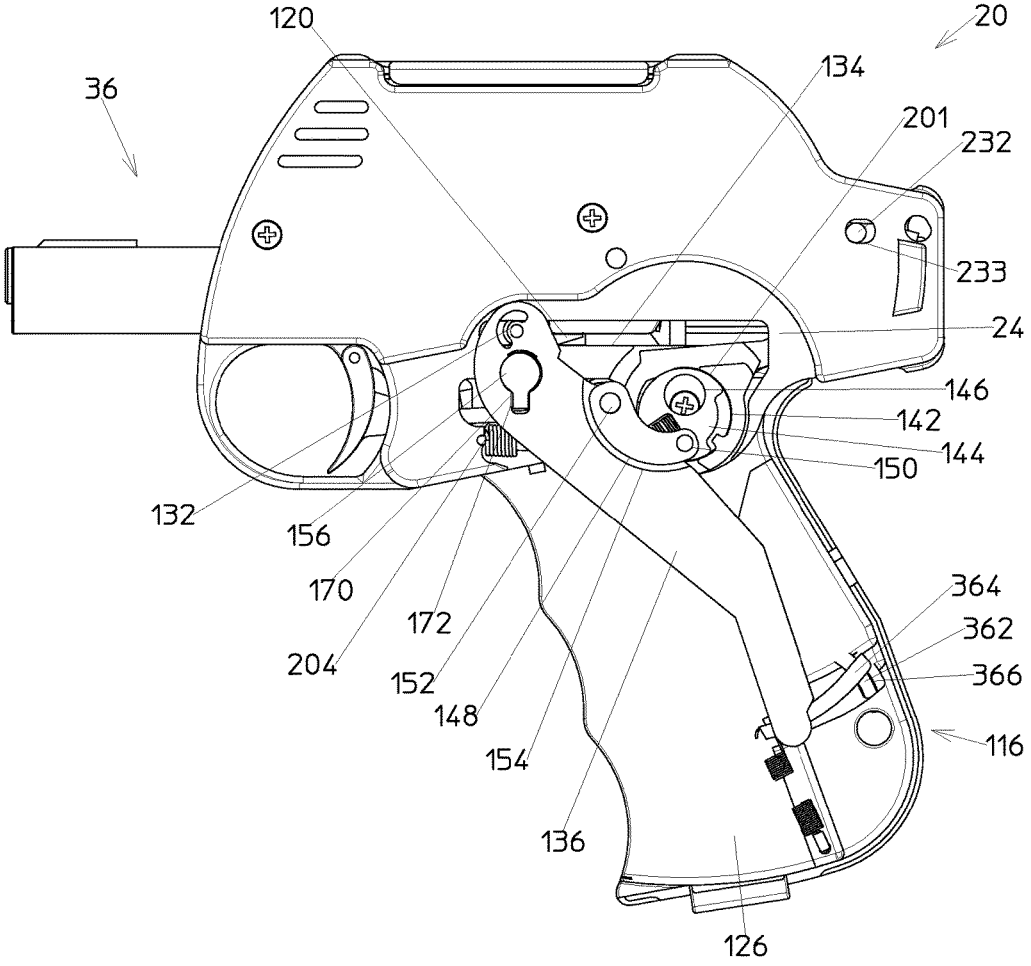
FIG. 16 is a left side view of the pistol showing internal mechanisms described herein for moving between the ready-to-fire position to the closed position, the ready-to-fire position shown here.
Figure 20A:
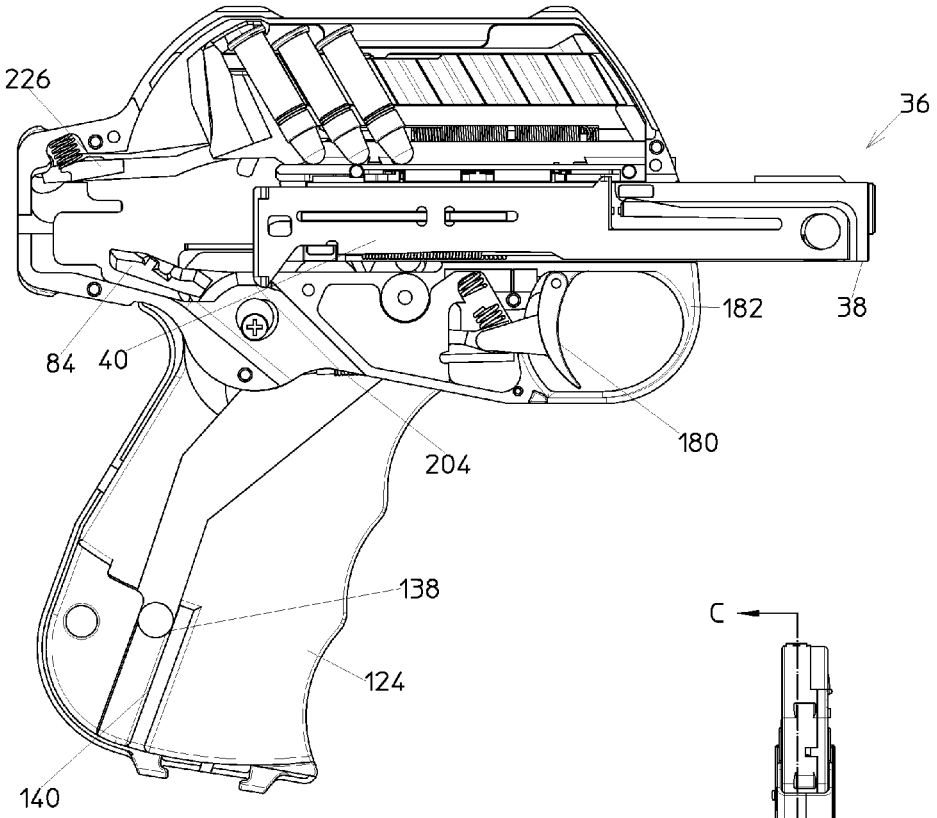
FIG. 20A is a right side view of the pistol with covering removed to show the firing operation of the pistol, here in the ready-to-fire state.
Figure 20B:
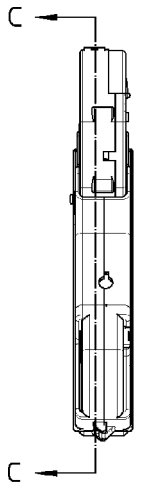
FIG. 20B is a back view of the pistol in the open position.

As shown in FIG. 10, the pistol handle 116 is formed of two joined pieces, a left piece 124 and a right piece 126. FIGS. 16 and 20A show the left side and right side of the pistol, respectively, in the same, ready-to-fire position. In FIG. 16 the left piece 124 of the handle is removed to show interior components of the pistol, including the interior of the handle right piece 126. In FIG. 20A, the right piece 126 of the handle is removed to show interior components of the pistol, including the interior of the handle left piece 124.

Figure 22A:
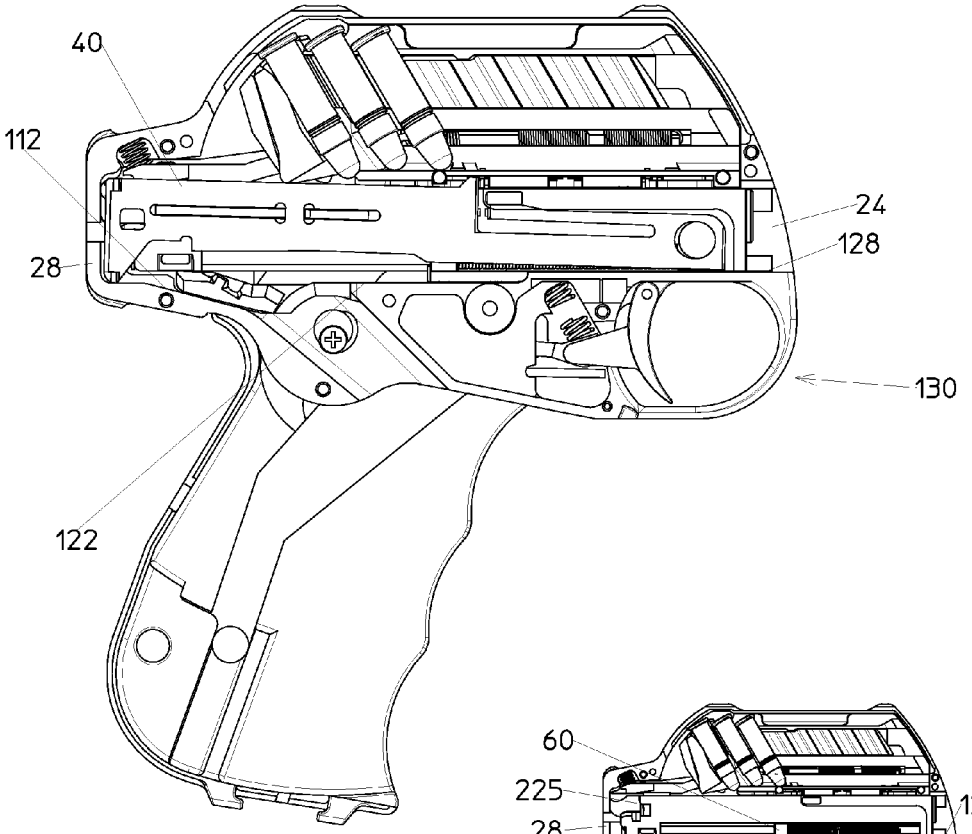
FIGS. 22A-22B are right side views of the pistol with covering removed to show the firing operation of the pistol, here illustrating the slide assembly fully recoiled after firing. The bolt component is omitted in FIG. 22B.
Figure 22B:
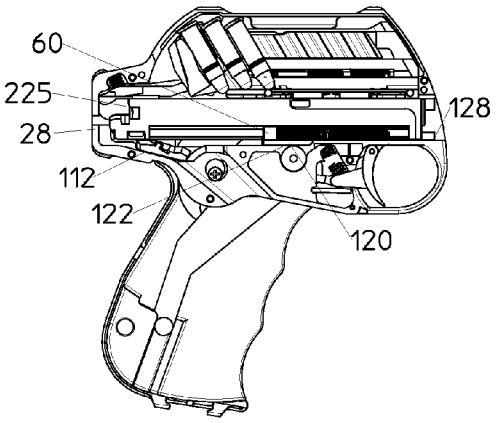

The muzzle end of the slide assembly 36 moves across the upper surface of a slide platform 128 (FIGS. 10, 22A-22B). The slide platform 128 is a horizontal member of the frame extending from the bottom of the muzzle aperture 34 inwardly therefrom over the trigger assembly 130 of the pistol. The innermost end of the slide platform 128 is stepped down slightly to form a junction with the above-mentioned guide platform 122. As noted above, the guide block 120 fits between the guide platform 122 and the underside of the slide assembly 36.

As shown best in FIGS. 12G, and 16-18, the guide block 120 also includes an opening 121 in part of the block 120 that protrudes through a guide slot 134 that is formed through the back plate 24 of the frame 22. The opening 121 receives a slide post 132 that is connected to an upper end of a handle link 136 (FIG. 16) that is part of a linkage system housed primarily in the handle 116 for controlling movement of the handle 116 and slide assembly 36 as the handle is manually moved to reconfigure the pistol in the open or closed position. The slide post 132 is rotatable within the opening 121.

The opposite, lower end of the handle link 136 includes a round follower post 138 (FIG. 20A) that fits into a camming slot 140 that is present between two raised features formed on the interior of the left handle piece 124. Consequently, the upper end of the handle link 136 is constrained to move along the guide slot 134 through which the slide post 132 extends, and the lower end of the handle link is constrained to move along the camming slot 140.

The handle 116 pivots between the open and closed positions about a pivot sleeve 147 that is formed in an interior boss 144 that is part of the frame 22. The boss 144 is a thickened portion of the frame in the vicinity where the handle joins the frame. The pivot sleeve 147 (FIGS. 11G-11K, FIG. 16) is a generally cylindrical member formed on the left side of the frame. Between the sleeve 147 and the remaining portion of the boss 144 there is an annular gap generally surrounding the sleeve, the significance of which is described below. The left piece 124 of the handle includes on its interior a pivot pin 146 (FIGS. 10, 19B) that is rotatably secured, via a fastener on the right side of the frame 22, in the pivot sleeve 147 to form the pivotal connection between the handle and frame. The right piece 126 of the handle is attached along part of its periphery to the left handle piece 124 to move therewith.

As the pistol is moved out of the ready-to-fire position (FIG. 16) toward the closed position, the rotational motion of the handle 116 about pivot sleeve 147 is transferred by the handle link 136 to translational motion of the guide block 120 via the slide post 132 that is constrained to move along the linear path defined by the guide slot 134. The associated rotation of the handle link 136 within the confines of a portion of the handle interior is assisted by a U-shaped drive link 148 (FIG. 16) that has one end pivotally connected to a fixed (relative to the frame) post 150 on the interior boss 144. The other end of the drive link 148 is pivotally attached at a post 152 carried on the handle link 136, that post 152 being located between the opposing ends of the handle link.

Figure 17:
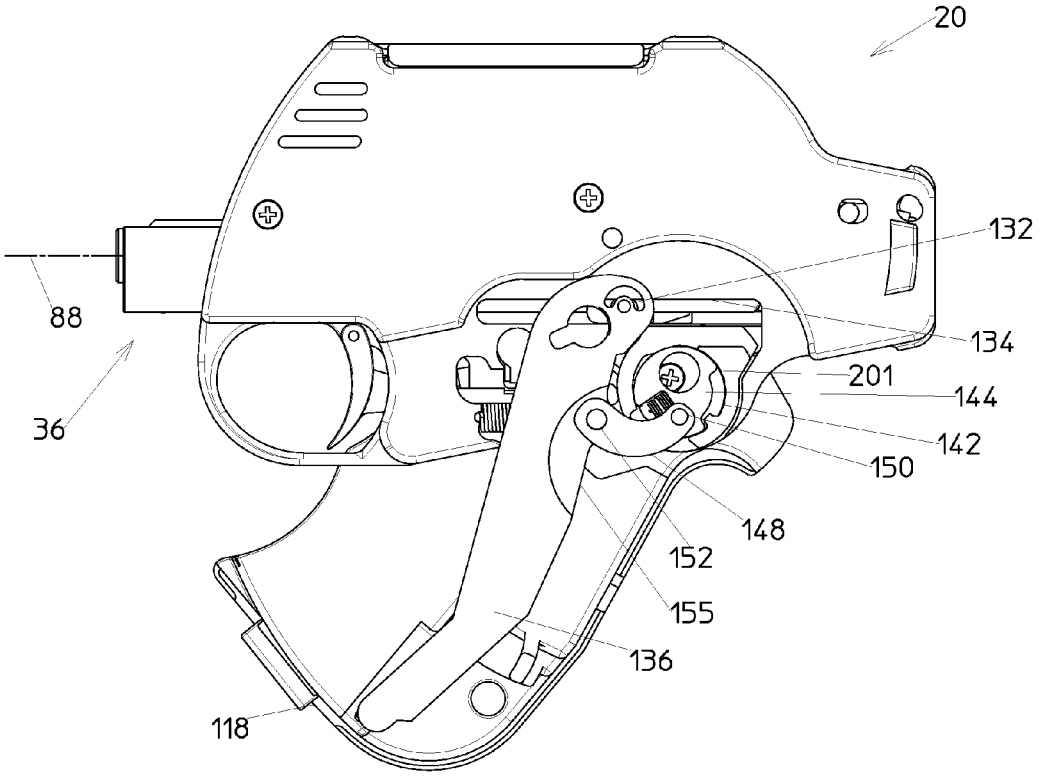
FIG. 17 is a left side view of the pistol showing internal mechanisms described herein for moving between the ready-to-fire position to the closed position, here illustrating the pistol between the ready-to-fire and closed positions.
Figure 18:
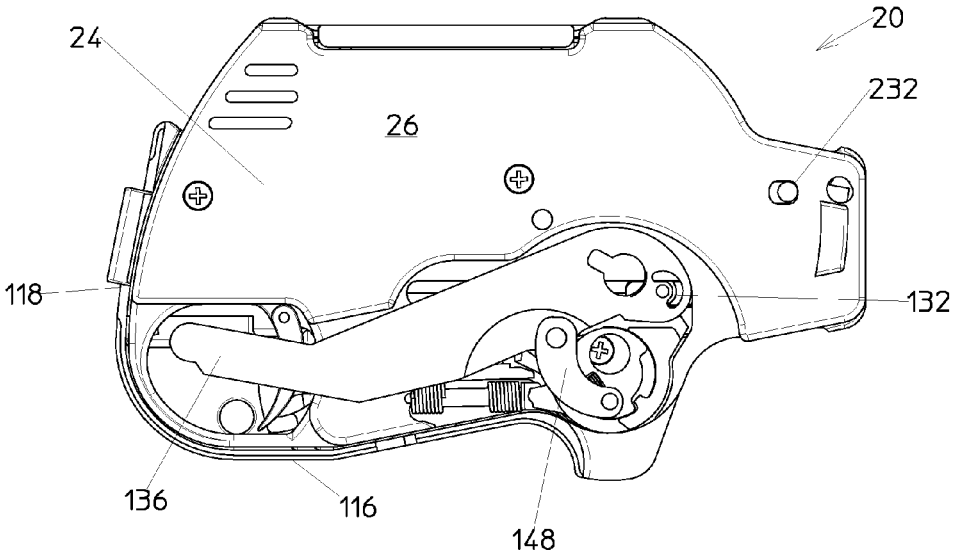
FIG. 18 is a left side view of the pistol showing internal mechanisms described herein for moving between the ready-to-fire position to the closed position, here illustrating the closed position.

The drive link 148 introduces lost motion into the linkage system, which can be readily appreciated by considering the movement of the pistol handle 116 out of the closed position (FIG. 18) toward the open position (FIG. 16) through an intermediate position (FIG. 17). Referring first to FIG. 18, counterclockwise rotation of the handle 116 is immediately transferred to the lower end of the handle link 136 via the follower post 138 and camming slot 140 mentioned earlier. In response, the handle link 136 initially rotates about the slide post 132 and that rotational motion is transferred via the drive link 148 directly to the clockwise rotation of the handle 116. During that initial rotation, the slide assembly 36 extends only very slightly (toward the left in FIGS. 16-18) because of the lost-motion effect of the drive link 148. This lost-motion linkage ensures that the handle 116 (in particular, the butt 118 of the handle) is rotated completely away from the muzzle aperture 34 before the muzzle end of the barrel moves into and through that aperture.

With reference to FIGS. 17 and 16, nearly all the motion of the handle link 136 in rotating from an intermediate position (FIG. 17) to the open position (FIG. 16) is transferred to the translational motion of the slide post 132 in the guide slot 134, hence to the translational extension of the muzzle end of the slide assembly 36 out of the muzzle aperture 34.

Conversely, as the handle 116 is manually rotated clockwise out of the open position (FIG. 16) toward the closed position, nearly all the initial clockwise rotational motion of the handle link 136 in rotating from the open to the intermediate position (FIG. 17) is transferred to the translational motion of the slide post 132, hence to the translational retraction of the slide assembly 36 through the muzzle aperture. This ensures that the muzzle end of the slide assembly 36 will be clear (inwardly) of the muzzle aperture 34 before the butt 118 of the handle moves across the muzzle aperture 34 to cover that aperture in the closed position.

It will be appreciated that the lost or delayed motion of the slide assembly 36 in moving into the fully retracted position as the handle is moved into the closed position (as well as the delayed motion as the handle is moved to open) provides the advantage of having a more compact frame size for a given barrel length as measured in the direction of the barrel axis 88 since the slide assembly may thus be "parked" just inside the muzzle aperture 34 and not farther retracted as the handle continues to move into the final, closed position.

Figure 11A:
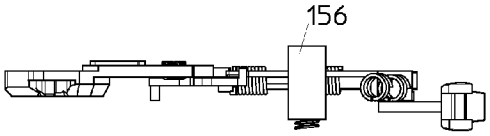
FIGS. 11A-11F are views of the trigger assembly of the pistol.
Figure 11B:
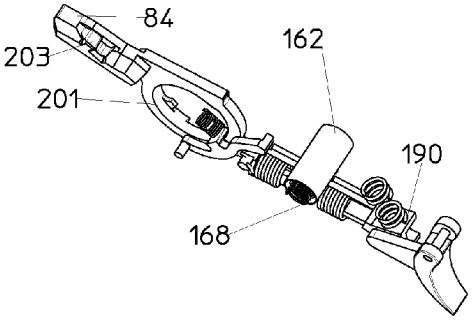
Figure 11C:
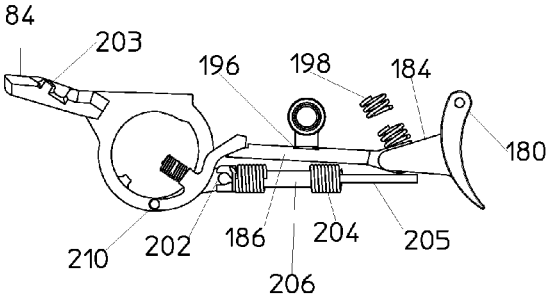
Figure 11D:
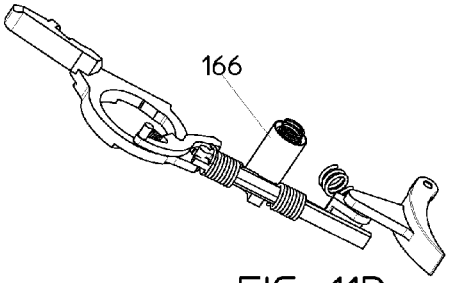
Figure 11E:
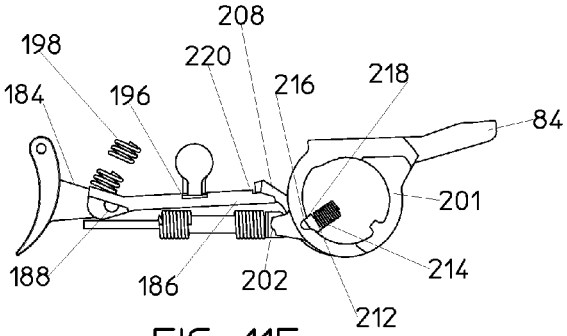
Figure 11F:
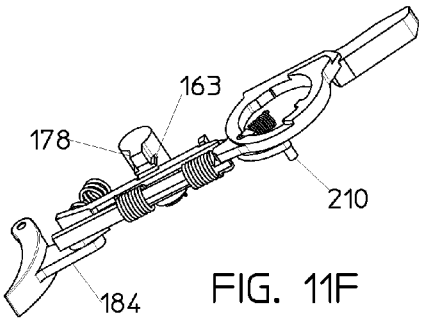
Figure 11G:
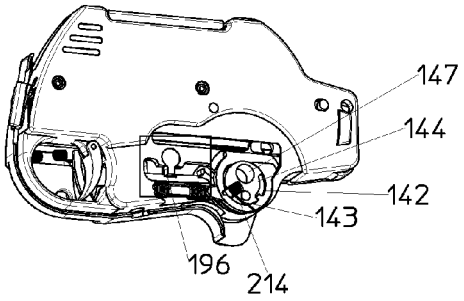
FIGS. 11G-11L are detail views of the trigger mechanism interlock described herein.
Figure 11H:
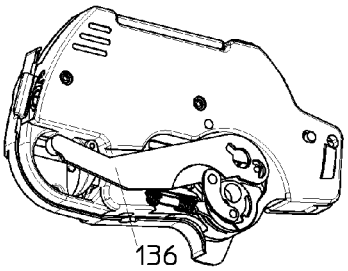

The handle link 136 includes a semicircular recess 154 on one side to provide clearance for the drive link 148 when the handle is in the open or ready-to-fire position (FIG. 16). Moreover, the straight edge 155 (FIG. 17) of the link 136 next to the recess 154 abuts a flat 143 (the flat is shown in FIG. 11G) formed in the sleeve 142 on the frame when the handle is in the fully open position. As a result, the handle link 136 is secured snugly in place within the handle and does not rattle or otherwise move in the absence of sufficient manual force to rotate the handle out of the open position.

Handle Lock

The handle 116 securely and automatically locks in the open position and must be manually unlocked in order to move the handle out of the open, ready-to-fire position. The mechanism for accomplishing this also serves as an interlock for disabling the pistol's trigger mechanism when the pistol is out of the ready-to-fire position, and for re-enabling the trigger mechanism only when the pistol is moved completely into the ready-to-fire position. This configuration makes the pistol safe to operate and carry.

Specifically, with reference to FIGS. 3, 11A-11L, and 16-18, a lock pin 156 is axially aligned with a lock bore 157 that is formed partly through a thickened part of the frame 22 near the trigger assembly 130. The lock pin 156 is accessible to touch by the user via an access hole 174 in the handle 116 on the left side (FIG. 3). The access hole 174 is generally keyhole-shaped, and the outer section 162 of the lock pin 156 conforms to that shape and extends through the access hole. Specifically, the outer section 162 of the lock pin 156 (FIGS. 11A-11L) is cylindrical except for a cuboidal lock tab 178 that extends downwardly from the otherwise rounded shape. The inner section 166 of the lock pin is cylindrical and includes a central bore within which a lock spring 168 is carried. The lock spring 168 extends inwardly to abut the inner wall of the lock bore 157.

When the pistol is in the ready-to-fire position, the inner section 166 and the lock spring 168 reside in the lock bore 157 with the spring 168 compressed against the inner wall of the lock bore so that the lock pin 156 is urged outwardly. In this orientation, the cuboidal lock tab 178 on the outer section 162 of the lock pin extends through a correspondingly shaped cut 172 that forms part of a keyhole-shaped lock aperture 170 that is present on the handle link 136 (FIG. 16). Thus, the lock pin 156 extends between both the handle link 136 and the lock bore 157 on the frame to prevent the handle link 136 (hence, the handle 116) from rotating out of the ready-to-fire position. Preferably, the innermost edges of the lock tab 178 carry flanges 163 (FIG. 11F) that do not fit outwardly through the cut 172 in the handle link 136, thus acting as stops to the spring-biased-outward position of the lock pin 156 when the handle is in the ready-to-fire position.

In this handle-locked state, the outermost surface of the outer section 162 of the lock pin is generally flush with the exterior surface of the handle 116 (FIG. 3) and exposed through an access hole 174 in the handle. A user may push inwardly on the lock pin 156 to compress the lock spring 168 and move the lock pin 156 axially out of both the access hole 174 in the handle and the lock aperture 170 in the handle link 136 so that the handle 116 is free to rotate out of the ready-to-fire position toward the closed position. In one embodiment, a hinged button 175 is formed in the handle to cover the access hole 174 and lock pin 156 to be depressed by the user against the lock pin 156 to move the pin fully through the lock aperture.

It is noteworthy here that the handle locking function of the lock pin 156 just described is complemented with a trigger assembly interlock provided by the same lock pin components. Specifically, when the lock pin 156 is moved axially inwardly to unlock the handle from the ready-to-fire position as just described, the cuboidal lock tab of the lock pin is moved to protrude into the trigger assembly in a manner that locks and thus disables the trigger mechanism as described more below.

Trigger Assembly

The trigger assembly 130 is illustrated in FIGS. 11A-11L, 20-25 and 30A-30F, and includes a conventional trigger pull 180, the top of which is pivotally attached via a pin 181 at a trigger guard 182 that loops in front of and under the pull 180. The trigger pull is concave on the forward side and the rearward side includes a fin 184 (FIG. 11C). Behind the trigger pull 180 (that is, toward the handle 116) extends a trigger bar 186. One end of the trigger bar is pinned (at 188) to the fin 184 of the trigger pull 180. The other end of the trigger bar 186 includes an inclined surface that is notched to form a trip post 220, as discussed below.

A stop notch 196 is formed on the trigger bar 186 (FIG. 11L) roughly midway along the length of the bar. A compressed return spring 198 (FIGS. 11C-11F and 20A) is captured in the frame so that one end of that spring bears against a spring seat 190 formed in the trigger bar 186 at the location 188 where that bar is pinned to the fin 184 of the trigger pull. The return spring 198 serves to normally urge that end of the trigger bar downwardly so that the trigger pull 180 pivots forwardly to place the pull in the ready position for releasing the hammer 84, as will be described.

Figure 11I:
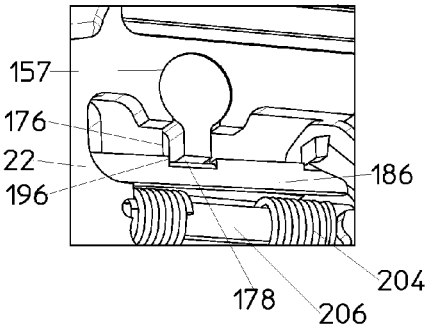
Figure 11J:
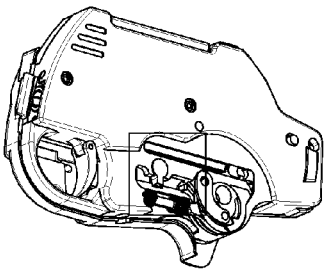
Figure 21A:
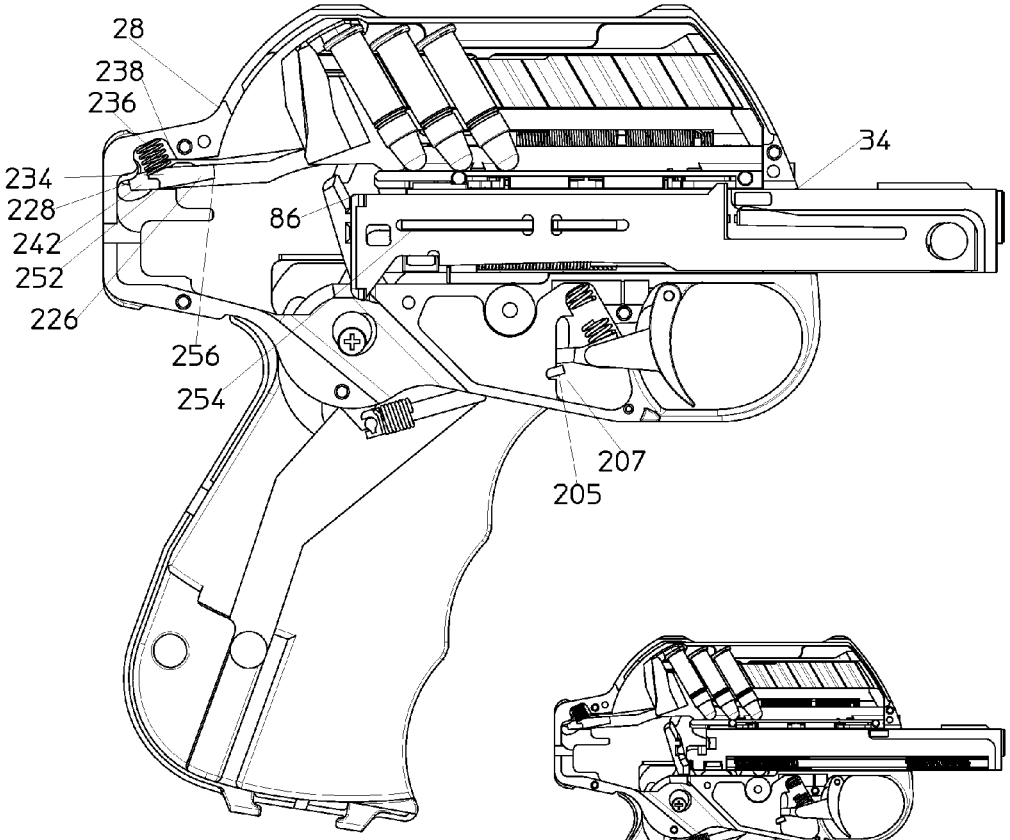
FIGS. 21A-21B are right side views of the pistol with covering removed to show the firing operation of the pistol, here illustrating the hammer released to strike the firing pin. The bolt component is omitted in FIG. 21B.
Figure 21B:
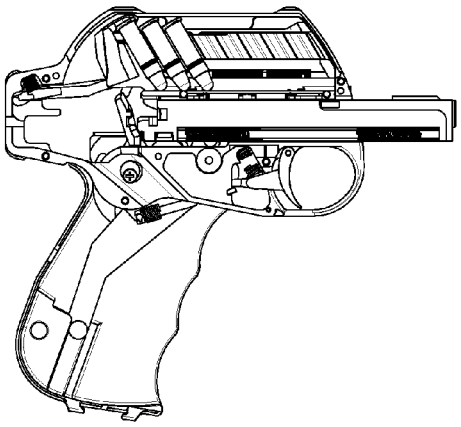
Figure 21C:
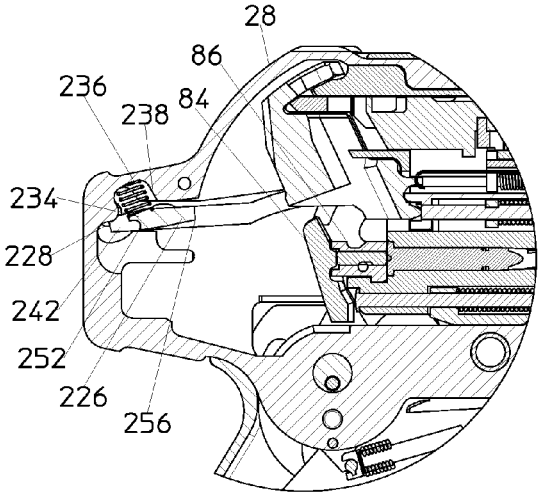
FIG. 21C is a partial sectional view, like FIG. 20C, but showing the pistol in the state illustrated in FIG. 21A.

The hammer 84 is integral with and is a generally a radial projection of a hammer annulus 201 that is mounted to fit within the annular gap that surrounds the pivot sleeve 142 part of the frame 22 (FIGS. 16-17). The outer end of the hammer 84 is formed to include a firing surface 203 (FIG. 11B) that engages the head 80 of the firing pin 78 upon release of the hammer (FIGS. 21A, 21C). The part of the hammer annulus 201 diametrically opposite to the hammer 84 includes an outwardly protruding stud 202 (FIG. 11E). A hammer (compression) spring 204 is carried on a spring guide 206 that has on end pivotally attached to the stud 202 (FIG. 11C). As shown in FIGS. 11I and 21A, the opposite end of the hammer spring 204 seats against the frame 22 around a pocket 207 made in the frame to receive the free end 205 of the spring guide 206. FIG. 11C illustrates the hammer 84 cocked (and locked, as explained next) such that the hammer spring 204 is fully compressed with the free end 205 of the spring guide 206 slid inside the frame pocket 207.

The hammer is locked in this cocked or ready position (FIG. 30A, 11C-E) by a hammer lock 208. Upon release of this lock via the trigger pull, the compressed energy in the hammer spring 204 is released to direct the hammer annulus 201 to swiftly rotate about the pivot sleeve 142 so that the hammer 84 strikes the head 80 of the firing pin. That lock 208 is a curved, elongated, sear-like member that is pivotally mounted at one end to the frame via a pivot post 210 (FIGS. 11C-11F) formed to protrude from one end of the hammer lock 208. The hammer lock 208 is configured to extend alongside the hammer annulus 201 and include a remote end that engages the trip post 220 formed in the end of the trigger bar 186. An arm 212 (FIG. 11E) extends from the midpoint of the hammer lock across the interior of the hammer annulus 201. The arm 212 includes a catch 218 that abuts against (engages) a tooth 216 that is formed by a notch in the hammer annulus. One end of a hammer lock (compression) spring 214 is attached to the arm 212 to urge the arm toward the annulus so that catch 218 and tooth 216 remain engaged. The hammer lock spring 214 extends from the arm 212 and is secured and compressed within a radial pocket formed in the pivot sleeve 142 (FIG. 11G). In short, the lock spring 214 urges the hammer lock 208 to pivot about the post 210 so that the tooth 216 on the hammer annulus engages the catch 218 formed the hammer lock arm. So engaged, rotation of the hammer with the hammer annulus 201 is prevented despite the hammer being cocked by the compression of the hammer spring 204.

With reference to FIGS. 30A-30F, the hammer 84 is released from this ready or cocked position when the trigger pull 180 is pulled rearwardly by the user. This pulling rotates the pull 180 about pin 181 so that the connected end of the trigger bar 186 moves against spring 198 and causes rotation about pivot pin 188 so that the end of the trigger bar 186 adjacent the trip post 220 rests against the end of the trigger lock 208 that is remote from the pivot post 210 on the lock. When the pistol is in the open position, the lock pin 156 is clear of the trigger bar (FIG. 30 B) such that further rearward movement of the trigger pull 180 translates the trigger bar 186 rearwardly so that the trip post 220 on the trigger bar pushes against the remote end of the hammer lock 208. This pivots that lock about post 210 so that the arm 212 moves away from the hammer annulus 201 (overcoming the compression in the hammer lock spring 214) by an amount sufficient to disengage the tooth 216 and catch 218 and free the hammer to rotate rapidly (energized by the relatively strong hammer spring 204) to the fire position (FIG. 30C) where the firing surface 203 on the hammer forces the firing pin 78 to fire the cartridge as described above.

Trigger Lock

Figure 11K:
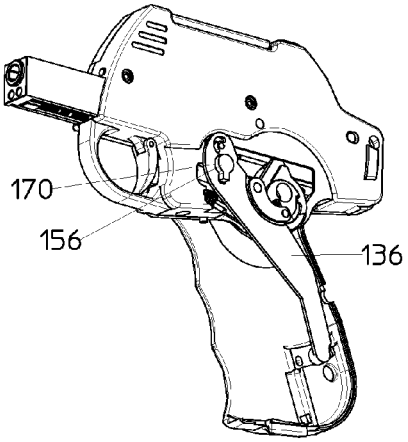
Figure 11L:
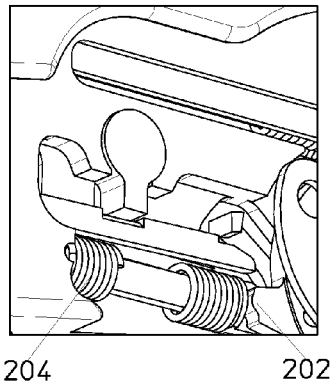

As noted earlier, the handle-locking function of the lock pin 156 is complemented with a trigger system interlock provided by the same lock pin components. Specifically, (FIGS. 11A and 11L) when the lock pin 156 is moved axially inwardly to unlock the handle as described above, the lock tab 178 is moved through a passage 176 in the frame to protrude immediately adjacent to the stop notch 196 formed on the trigger bar 186 (FIG. 11I). As a result, the trigger pull 180 is unable to move the trigger bar 186 from the ready-to-fire position to initiate the hammer release sequence just described because motion of the trigger bar is prevented by the presence of the lock tab 178 in the stop notch 196 (FIG. 11I). Specifically, the lock tab 178 touches the trigger bar 186, (FIG. 30A) thus becoming a rotation point that makes the trip post 220 pivot down and off of the end of the hammer lock 208 so that post 220 does not push against the hammer lock to release it. (As an alternative to the notch 196 formed on the trigger bar as discussed above, the trigger bar could be beveled in that region to enable the lock tab 178 to slide over the beveled region into the locked position.) The pistol, therefore, will not be operative in such a state (that is, unable to fire), and the trigger assembly will be operative again only when the pistol is moved into the ready-to-fire position whence the spring-biased lock pin 156 is free to retract for unlocking the trigger bar while simultaneously locking the handle in the ready-to-fire position (FIG. 11K).

Handle Latching

Figure 7A:
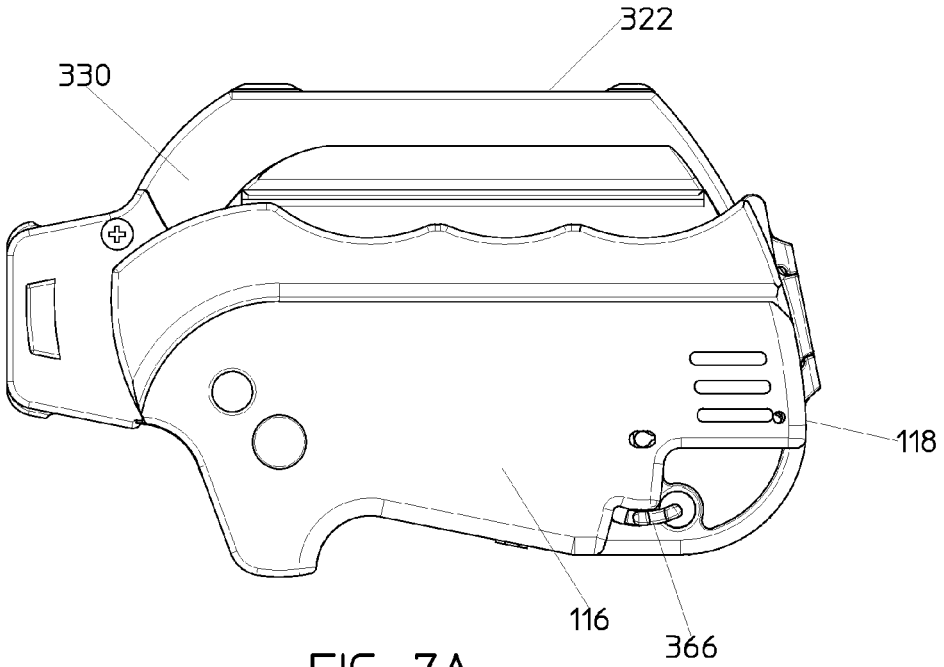
FIG. 7A is an elevation view of the right side of the pistol in the closed position.
Figure 7B:
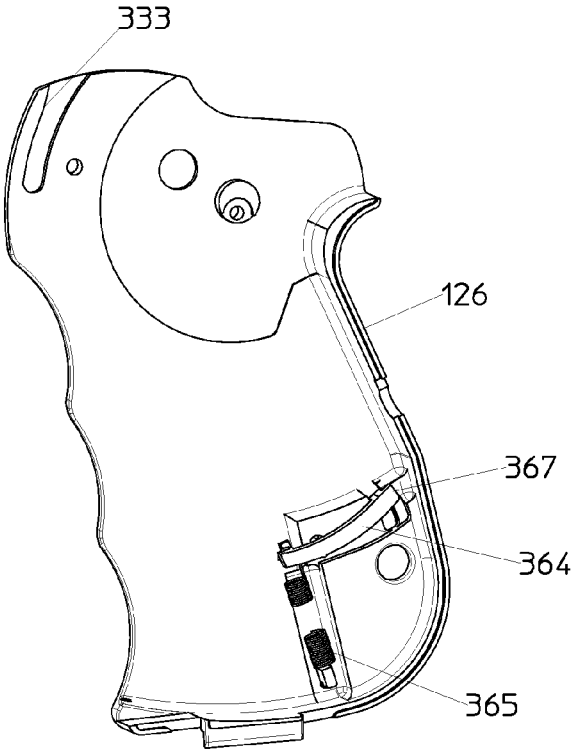
FIG. 7B is an interior view of the right side of the handle, illustrating handle latch components.
Figure 7C:
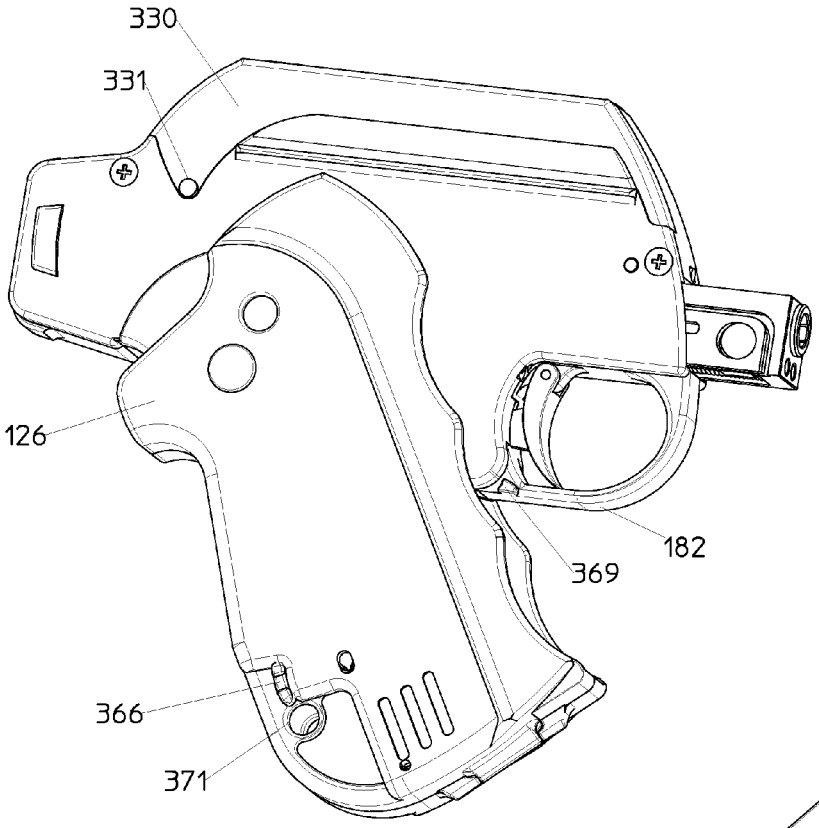
FIGS. 7C and 7D are perspective views of the pistol in a closing position and closed position, respectively.
Figure 7D:
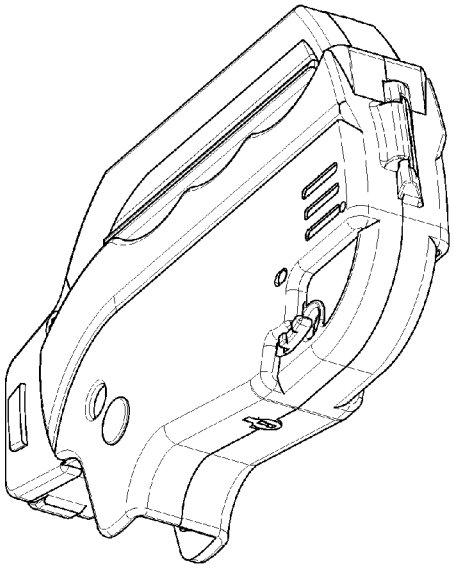

With reference to FIGS. 2, 7A-7D and 10, the handle 116 is latched in the closed position by a handle latch 362 that is primarily carried in the base of the hollow handle. With reference to FIG. 7B, the latch comprises a lever 364 that is pivotally attached to the right piece 126 of the handle. The pivot location is between an inner end and an outer end 367 of the lever. A latch spring 365 is fastened in tension to the inner end of the lever 364 so that the outer end 367 of that lever is normally urged into a latched position as shown in FIG. 7B. That end of the lever includes an attached knob 366 that extends through an arc-shaped slit in the handle (FIG. 7A). The knob 366 is slid by the user to overcome the force of the spring 365 and move the lever 364 out of the latched position. A protruding lock feature 369 is present on the right side of the trigger guard 182 (FIG. 7C). As the handle 116 is moved into the closed position, the lock feature 369 and latch lever 364 come into contact, and the lever is forced by the feature to pivot out of the path of the feature. As the handle moves into the fully closed position (FIG. 7D) the outer end of the lever slides past the feature and the lever snaps back (owing to the latch spring tension) to the latched position. In this position, the outer end 367 of the lever abuts the feature 369 and prevents the handle from moving out the closed position until the user deliberately slides the knob 366 (and attached lever 364) in a release direction (that is, away from the abutting contact with the feature) so that the handle can be moved toward the open position.

The handle 116 includes a through hole 371 formed adjacent to the latch knob 366 (FIG. 7C). The hole 371 is sized to accommodate the shackle of a padlock, and located so that the presence of a lock shackle will prevent movement of the latch knob 366 into the release position. Additionally, the shackle loops around the trigger guard 182, thereby preventing the handle from moving away from the guard 182 to open. An alternative or supplemental lock is shown in FIGS. 4 and 19B, where the back of the handle can accommodate an integrated lock 370 that extends inwardly to engage the frame and thus prevent the pistol from opening.

Firing Operation

Referring primarily to FIGS. 20-25, this description now turns to the positions or states assumed by the components of the slide assembly 36 as the pistol is operated to fire a cartridge and then automatically readied to fire subsequent cartridges.

Figure 20C:
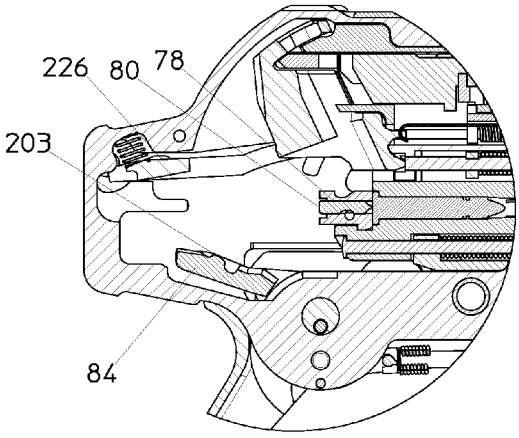
FIG. 20C is a partial sectional view, taken along line C-C of FIG. 20B, of the pistol in the state illustrated in FIG. 20A.
Figure 30A:
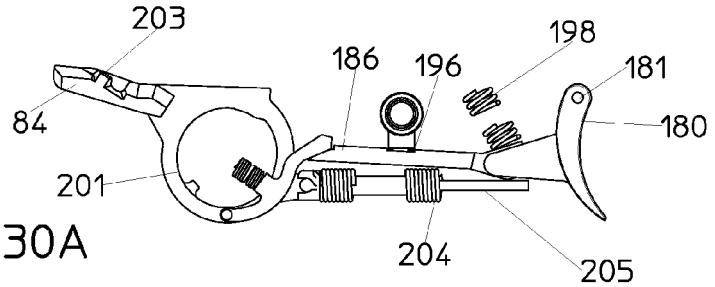
FIGS. 30A-30F are right side detail views of the trigger assembly of the pistol in certain states during operation of the pistol as described herein.
Figure 30B:
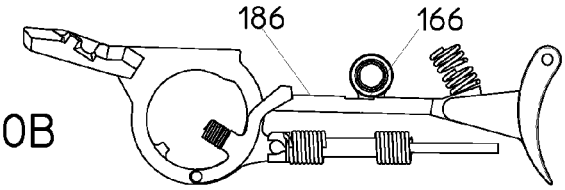
Figure 30C:
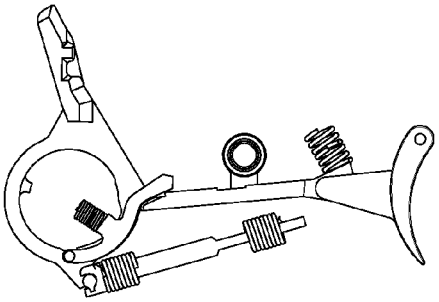
Figure 30D:
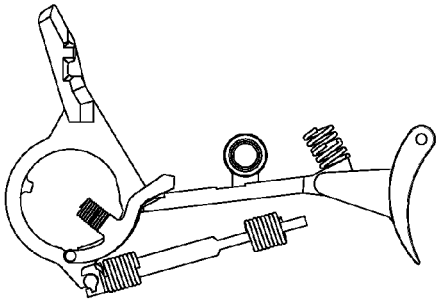
Figure 30E:
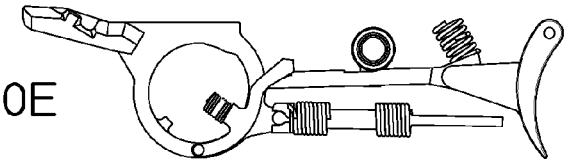
Figure 30F:
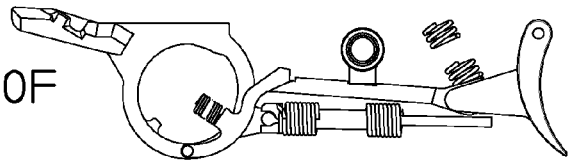

FIGS. 20A and 20C illustrate the pistol in the ready-to-fire position wherein the hammer 84 is cocked as noted above in connection the description of the trigger assembly. The user pulls rearwardly on the trigger pull 180 to fire the pistol such that the hammer firing surface 203 strikes the head 80 of the firing pin 78 (FIG. 21A, 21C). The recoil force attributable to firing of the cartridge rapidly moves the slide assembly 36 into the full recoil state shown in FIGS. 22A-22C. The recoiling slide assembly 36 engages the hammer to forcibly rotate it back to the ready position (FIG. 22C) whence the hammer lock 208 may again secure the hammer in the cocked position as shown in FIGS. 20A, 20C and 30F). In this regard, it is noteworthy that even though recoil force moves the hammer into the cocked position, the pistol cannot be fired again should the user continue holding the trigger pull 180 rearwardly after firing (FIG. 30E) because in this position the trip post 220 of the trigger bar 186 will be disengaged from the hammer lock 208 and thus unable to push against the free end of the hammer lock 208 to disengage the tooth 216 and catch 218 to free the hammer to fire again. The trip post 220 will not be repositioned forward of the hammer lock until the user releases the rearward force on the trigger pull 180 by an amount sufficient to enable the return spring 198 to move the trigger bar 186 upwardly and slightly forwardly, back into the ready-to-fire position (FIG. 30F).

The motion of the slide assembly 36 is guided in part by a pair of linear ribs 222 that protrude from the face 64 of the barrel body 42 (see FIGS. 12D and 26B) to mate with correspondingly shaped grooves formed in the inside of the frame cover 30. The back side 223 of the barrel body 42 (FIG. 12G) extends downwardly to contact the slide platform 128 in the frame since that side 223 does not include a cutout or opening as does the opposite face 64 of the barrel body in the vicinity of the spring guides 52, 54. The underside of the slide assembly 36 is guided in part to the recoil state (that is, moving from the state shown in FIG. 21A to that shown in 22A) by the above-described slide platform 128. Specifically, the muzzle end of the slide assembly 36 slides along the slide platform 128.

As the breech end of the slide assembly 36 approaches the full recoil position (shown in FIG. 22A), the sled 108 that depends from the bolt breech block 86 engages the camming feature 112 present on the inner surface of the frame near the breech (FIGS. 22A-22B), which has the effect of slightly lifting that end of the bolt 40 (as well as the firing pin 78 retained in the breech block) relative to the barrel breech just as the bolt 40 reaches the fully recoiled state. This lifting also has the effect of placing the catch groove 99 on the top of the bolt into the path of a latch 226 that is pinned to the frame (FIG. 13B, 21A-21C) for spring-biased rocking motion. The latch 226 temporarily secures the bolt in a latched position (shown in FIG. 23A, 23C) as associated mechanisms extract and expel the spent cartridge in the breech 46 and prepare another, live cartridge for loading therein as described more below.

It is noteworthy here that despite the slight, vertical lifting of the bolt relative to the breech end of the barrel, the breech remains closed with the cartridge chambered in the breech because the bolt and barrel are not appreciably separated in the direction of the barrel axis 88 until the barrel begins to return to the ready-to-fire position. Put another way, the breech remains closed until the slide assembly 36 is fully recoiled, which provides the advantages of reducing the effect of the recoil force felt by the user, and minimizing any contamination of the pistol interior by material that would otherwise be blown back out of the breech if the breech opened earlier than after full recoil.

It is also notable that as a result of the vertical lifting of the bolt relative to the breech end of the barrel, the firing pin 78 carried in the firing aperture 98 of the breech block 86 also shifts upwardly by an amount such that the tip 100 of the firing pin is no longer aligned with the cartridge rim (or with the primer of a center fire-type cartridge) and is thus unable to fire the pistol (FIG. 22A). This enhances the pistol safety since in this lifted position of the bolt, the breech is not secure for firing purposes. Moreover, since the head 80 of the firing pin resides in a counterbored aperture 98 as described above (FIG. 12L), the portion of the breech block that surrounds the firing pin head at the counterbore will interfere with contact between the firing surface 203 of the hammer and the firing pin whenever the bolt is raised from (not seated in) the breech end of the bolt, or when the sliding assembly is shifted out of the ready-to-fire position. This interference further enhances the safety of the firing mechanisms. As shown in FIG. 12I and FIG. 22B, at the breech end of the barrel 38 the right side of the barrel is formed to include a small ramp 225 that is inclined relative to vertical to provide clearance as the breech end of the bolt lifts from the barrel as just noted.

Inasmuch as the handle 116 and handle link 136 are locked in the ready-to-fire position as described above, the guide block 120, which is connected to the locked handle link 136 via the slide post 132, is also locked in position and unable to slide rearwardly during recoil of the slide assembly. As a result, both the main spring 56 and the bolt spring 58 are compressed against the spring stop 60 when the slide assembly is in the fully recoiled state (FIG. 22A). As soon as the recoil force dissipates, the compressed main spring 56 expands to force the barrel 38 fully forward (FIG. 23A), while the latch 226 secures the bolt in its latched state against the force of the compressed bolt spring 58.

Breech Latch

The latch 226 (FIGS. 13A-13H) is located at the rear of the frame (the left side of the frame as viewed in FIG. 21A) opposite to the muzzle aperture 34. The latch 226 includes an elongate, generally flat arm 230 near one end of which a pivot pin 232 protrudes into a short slot 233 that is formed in the back plate 24 of the frame (FIGS. 16 and 18). The end of the pin 232 is exposed in the slot for manipulation by the user as will be explained later. On the opposite side of the pin 232, the latch includes a base 234 that extends inwardly by an amount sufficient to place it in the path of the recoiling bolt 40. The upper surface of the base 234 defines a seat for a compressed latch spring 236 that extends away from the base to be secured within a pocket 238 formed in the frame (FIG. 21A, 21C). A notch 228 having opposing flat, parallel surfaces is formed in this part of the frame adjacent to the pocket 238. The trailing end 242 of the latch arm 230 fits partly into the notch, which helps keep the arm 230 in a single plane as it moves. When the pistol is in the ready-to-fire position (FIG. 20A) the spring 236 urges the base 234 downwardly and the latch 226 thus pivots into a position where the underside 256 of the base is in the path of the breech block 86 of the bolt as it recoils with the slide assembly 36.

The pivoting or shifting motion provided by the mounting arrangement of the latch 226 as just described enables the latch 226 to catch and subsequently release the recoiled bolt 40. In this regard, the rearward facing side of the latch base 234 defines a bolt hook 252, which is essentially a downward opening 90-degree cut in that side of the base 234. The underside 256 of the latch base 234 is inclined with respect to the path of the recoiling bolt. As a result, the recoiling breech block 86 of the bolt approaches and contacts that underside 256, and the base 234 is pushed out of the path of the bolt so that the latch 226 pivots slightly about the pin 232.

Figure 22C:
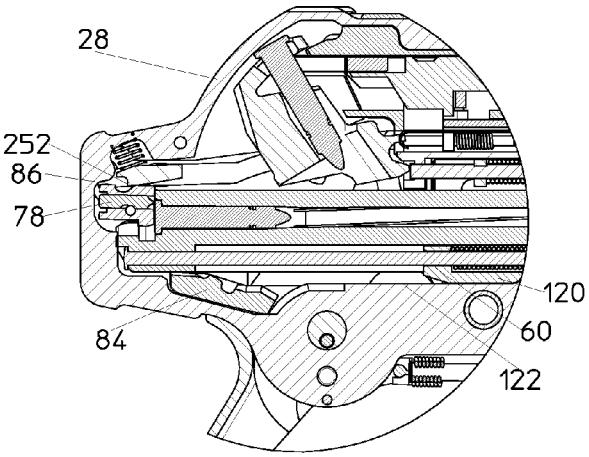
FIG. 22C is a partial sectional view, like FIG. 20C, but showing the pistol in the state illustrated in FIG. 22A.

As the breech block 86 continues to move in contact with the underside 256 of the latch base 234, the spring 236 continually urges the base against the beech block. The recoil force moves the catch groove 99 atop the breech block rearwardly, slightly beyond the latch base 234 into the full recoil position of the bolt (FIG. 22A, 22C). Next, the bolt spring 58 force that urges the bolt forwardly moves the breech block slightly forwardly until the catch groove 99 atop the breech block 86 slides under the bolt hook 252, so that the bolt hook 252 moves into place for engaging the catch groove 99 to temporarily latch the bolt in the breech-latch position (FIG. 23A, 23C) until the bolt hook 252 is later released as explained below. The engagement of the bolt hook 252 and groove 99 pulls the latch 226 slightly forwardly such that the latch pivot pin 232 is pulled against the forward edge of the slot 233 that is formed in the back plate 24 of the frame (FIG. 16).

With particular reference to FIGS. 12J-12K, 21A and 23B, the bolt 40 carries a cartridge extractor 254. The extractor 254 has an elongated body that fits inside of a correspondingly shaped extractor slit 253 in the bolt. A recess 255 is formed in the extractor 254 to receive a bar 257 formed in the bolt. The bar 257 is present where part of the slit 253 is not cut completely through the bolt. With the recess 255 and bar 257 engaged, the extractor is secured in the slit 253 for movement with the bolt. The rearward or breech end of the extractor includes a wedge 259 comprised of a pry surface 261 formed as a flat surface extending inwardly from the point of the wedge in a plane that is perpendicular to the bore axis 88 (that is, perpendicular to the motion of the slide assembly). The other, contact surface 263 of the wedge is in a plane that is inclined relative to the bore axis 88, as shown in FIG. 12K. At the end of the extractor away from the wedge 259, the extractor is thinned somewhat to facilitate slight bending of the extractor at the wedge end, as will be described below.

With the slide assembly 36 (that is, bolt 40 and barrel 38) in the recoiled position (FIG. 22A) the extractor wedge 259 fits into a chamfer 93 formed on the rear of the right face 64 of the barrel. The chamfer 93 exposes part of the rim 102 of a cartridge that is chambered in the bore of the barrel such that the pry surface 261 of extractor wedge 259 will abut the muzzle-facing side of the exposed rim 102. As mentioned above, the compressed main spring 56 expands to force the barrel 38 fully forward (FIG. 23A) out of the recoil position, while the latch 226 continues to secure the bolt in a latched state against the force of the compressed bolt spring 58 (FIG.

23B). Consequently, the extractor carried on the bolt also remains in place as the barrel 38 moves fully forward. As a result, forward motion of the spent cartridge in the barrel is prevented by the rim-abutting stationary pry surface 261 of the wedge, thus extracting the spent shell 104 from the bore, as shown in FIG. 24B).

Figure 23C:
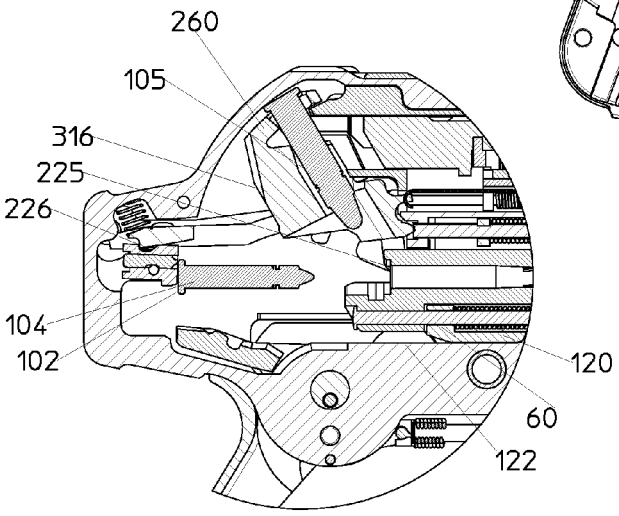
FIG. 23C is a partial sectional view, like FIG. 20C, but showing the pistol in the state illustrated in FIG. 23A.

With particular reference to FIGS. 23A-23C, the state of the pistol with the barrel fully extended forwardly and the bolt secured by the latch 226 in the fully recoiled position is referred to as the "open breech" state. As noted above, as the compressed main spring 56 expands to force the barrel 38 fully forward after the recoil force dissipates. As a result, the barrel is not latched in the recoil state and as the barrel returns to the ready-to-fire position, the spent cartridge 104 is extracted from the breech 46 because its rim 102 is secured by the bolt-carried extractor 254 as described above. (The figures all show cartridges that include a shell as well as the bullet and will be referred to as a "live" cartridge, but it will be appreciated that in instances where this description references a "spent" cartridge or shell, the bullet is not present despite the drawing. A live, unfired cartridge in the chamber can be manually extracted by closing and opening the handle 116. Thus, figures showing extraction of a live cartridge are accurate in this regard.)

During the brief time period that the pistol is in the open breech state, the spent, extracted shell 104 is expelled and a live cartridge 105 is delivered from a magazine 258 above the pistol barrel into alignment with the breech before the bolt is released and propelled by the bolt spring for chambering the live cartridge and closing the breech in the ready-to-fire position. Much of this action performed on the cartridges is effected by a transporter 260 that is actuated, in part, by the motion of the slide assembly 36 and an associated actuator assembly 264 as described below.

Before turning to a description of the transporter 260, it is noteworthy here that when the pistol is moved from the open position (FIG. 16) to the closed position (FIG. 18), the returning, rearward end of the slide assembly 36 will contact the breech latch 226 in a manner that causes the latch to move rearwardly until the latch pivot pin 232 to pushed against the rearward edge of the slot 233 that is formed in the back plate 24 of the frame (FIG. 18.) In the closed position, therefore, the breech latch is not engaged, and upon reopening of the pistol, the entire slide assembly will return to the forward position. That is, the bolt will not be held in the open breech position and consequently, the transporter 260 will not deliver another cartridge for chambering. It may occur, however, that a user may desire to have the pistol open with the bolt latched in the open breech position, such as when the user knows that there is no cartridge in the chamber. In this instance, the user may manipulate the latch pivot pin 232 by moving it to the forward edge of the slot 233, while the pistol is closed to thus manually cause the latch bolt hook 252 to engage the catch groove 99 on the bolt. As the pistol then moves to the open position, the transporter will deliver a cartridge for chambering and subsequently release the latch as described below. Put another way, the user can manually override the normal sequence of the breech latch system when desired.

Transporter

With reference first to FIGS. 15A-15F, the transporter 260 is pivotally mounted to the back plate 24 of the frame 22 via an integral pivot post 262 that is journalled to a correspondingly sized opening formed in the frame. As a result, the pivot location of the transporter 260 is fixed relative to the frame. The transporter 260 includes a tab 266 near the pivot post. The tab 266 projects toward the muzzle end of the pistol. The tab 266 anchors one end of a transporter spring 268, and the other end of the spring 268 is connected to a distal tab 267 that protrudes from a mounting bracket 269. (FIGS. 10, 15A and 26C; to facilitate description, the bracket 269 is omitted from several figures to expose components it otherwise hides.) The mounting bracket 269 is a rigid piece that is pinned (via a pair of posts 271 on each side of the bracket 269) between the frame back plate 22 and cover 30, just above the slide assembly 36. The transporter spring 268 is at all times in tension for urging the transporter 260 to rotate (clockwise in FIG. 23B) toward a docking position adjacent to the magazine 258. There, a live cartridge 105 at one end of the magazine is secured in a carriage 270 that is part of the transporter 260 on the end of the transporter.

Figure 26A:
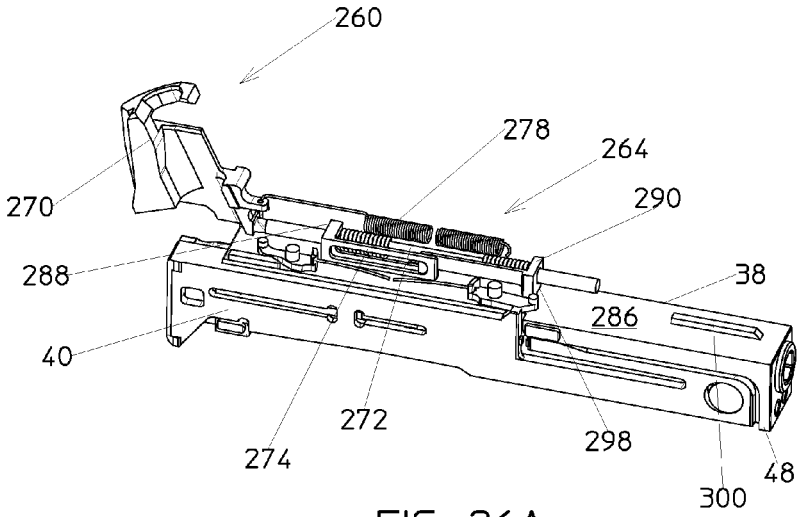
FIGS. 26A-26C are perspective views illustrating the operative relation between the slide assembly and the transporter system for moving both live and spent cartridges as described herein.
Figure 26B:
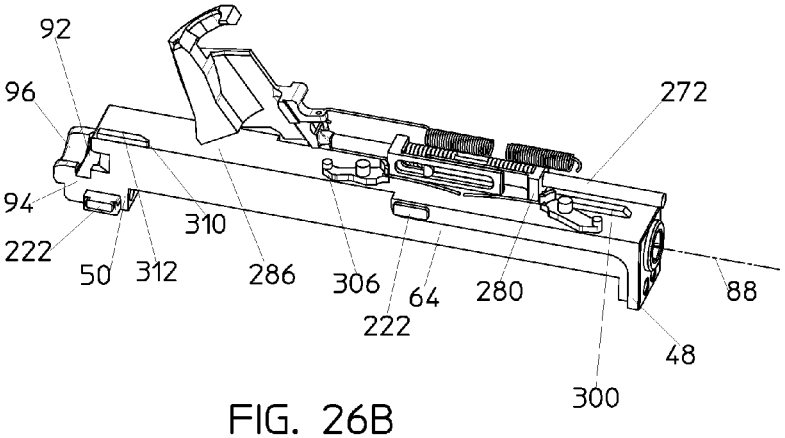
Figure 26C:
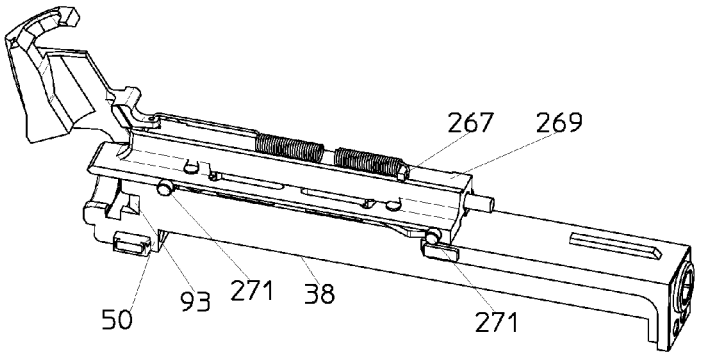

The actuator assembly 264 is mounted for limited sliding motion along the top surface 286 of the barrel 38 as shown in FIGS. 26A-26C. The motion of the barrel 38 affects the actuator assembly such that a spring-loaded ramrod 272 on the actuator assembly 264 is released to force the transporter 260 (with the live cartridge) to rotate out of the docking position (FIG. 23B) and into a breech position (FIG. 24B, 24C) for expelling the extracted, spent cartridge 104; aligning the live cartridge 105 with the breech 46; releasing the bolt from the latch 226; and guiding the resulting motion of the bolt's breech block 86 to chamber the live cartridge and close the breech so that the tension in the transporter spring 268 will thereafter return the transporter 260 to the docking position.

Figure 15B:
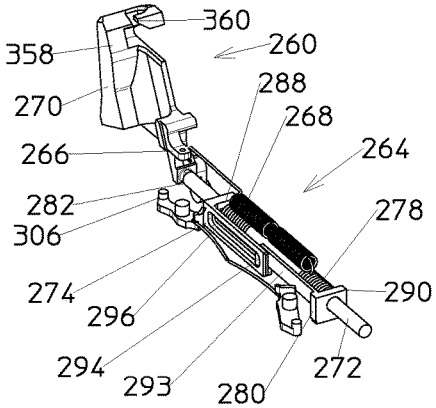
FIGS. 15A-15G are views of the transporter system for moving cartridges from the magazine to the breech of the pistol as well as for ejecting spent cartridges.
Figure 15A:
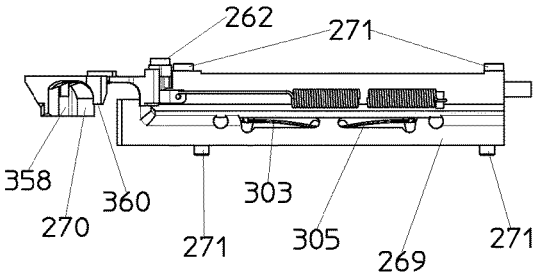
Figure 15C:
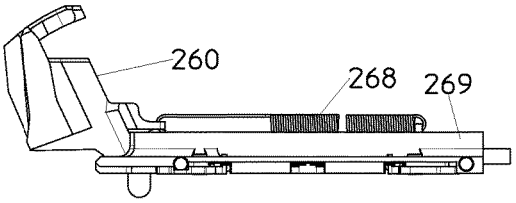
Figure 15D:
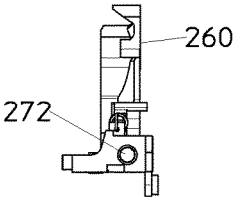
Figure 15E:
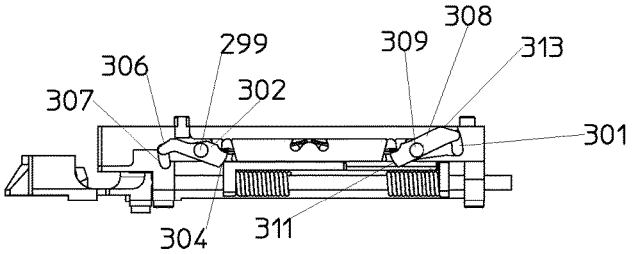
Figure 15F:
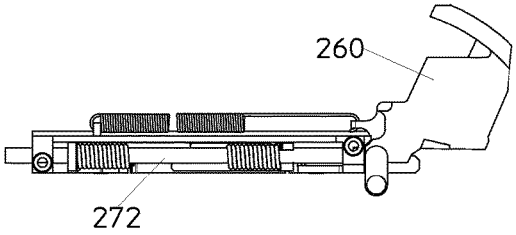
Figure 15G:
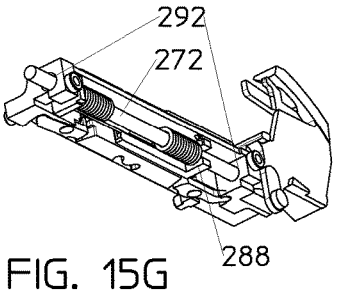

The actuator assembly 264 comprises a rod mount 274; a ramrod 272; ramrod spring 278; and a spring loader 280 (FIG. 15B). The opposing ends of the ramrod 272 pass through holes 292 formed through each end of the mounting bracket 269 (FIG. 15G). The ramrod 272 is fixed near its business end 282 to the rod mount 274. The rod mount 274 comprises a base that slides along the top surface 286 of the barrel (FIG. 26B). A notched plate 288 extends upwardly from one end of the base. A peripheral groove is formed in the ramrod 272 and mates with the notched plate 288 to secure the ramrod 272 to the plate and prevent axial motion of the ramrod 272 relative to the rod mount 274. The end of the ramrod 272 opposite its business end 282 extends through an aperture in a spring stop 290 that projects across the axis of the ramrod from one end of the spring loader 280 (FIG. 15B). The ramrod spring 278 is carried on the ramrod 272 between the notched plate 288 on the base of the rod mount 274 and the spring stop 290 of the spring loader 280.

The spring loader includes a thin plate portion 293 that extends partway alongside the ramrod 272 to terminate in a toe 294 that fits into a slot 296 that is present in a thin plate portion of the rod mount 274, that portion also extending partway alongside the ramrod 272. Thus, as best shown in FIG. 15B, the spring loader 280 and the rod mount 274 are connected by the toe 294 that fits into the slot 296 such that the toe 294 can slide along the length of the slot as the spring loader 280 and rod mount 274 move toward and away from one another as will be explained below.

At the muzzle-facing front edge 298 of the spring stop 290 (FIGS. 26A-26C), the stop 290 extends laterally across a portion of the width of the top surface 286 of the barrel. That edge 298 is in the path of a raised block 300 on the barrel surface 286 near the muzzle end of the barrel. The block 300 (FIG. 26B) will thus abut the edge 298 of the spring stop 290 to force the plate toward the rod mount 274 as the barrel recoils.

Two motion control mechanisms are associated with the actuator assembly 264. One mechanism comprises a pivoting, rear stop bar 302 attached via a pivot pin 299 to the underside of the mounting bracket 269 (FIGS. 15E, 15G). The bar 302 is shaped to include a curved stop gate 304 on one end of the bar. The gate 304 is urged inwardly by an elongated spring 303 (FIGS. 15A and 27A) that has one end anchored near the center of the underside of the mounting bracket 269, and the other, free end of the spring bearing against the stop gate 304. The other end of the rear stop bar 302 is shaped to have a curved or tapered release tip 306 that includes a post that moves into an arc-shaped guide groove 307 that helps guide the rear stop bar 302 through the pivoting motion described below (FIG. 15E). The other motion control mechanism is a front stop bar 308 that is attached via a pivot pin 309 to the underside of the mounting bracket 269. That bar 308 also includes a curved stop gate 311 at one end. That gate 311 is urged inwardly by an elongated spring 305 (FIGS. 15A and 27A) that has one end anchored near the center of the underside of the mounting bracket 269, and the other, free end bearing against the stop gate 309. The other end of the front stop bar 308 is shaped to have a curved or tapered release tip 313 that includes a post that moves into an arc-shaped guide groove 301 that helps guide the front stop bar 308 through the pivoting motion described below (FIG. 15E).

Figure 27A:
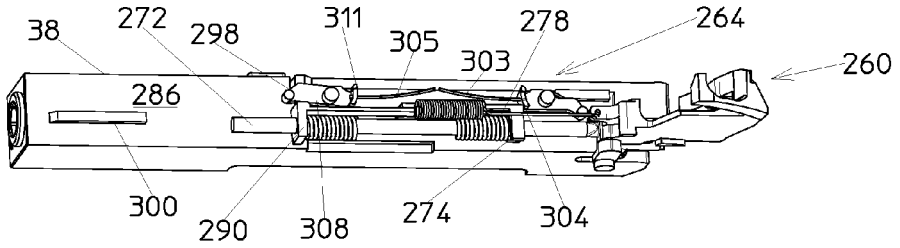
FIGS. 27A-27E are perspective views, from above, further illustrating the operative relation between the slide assembly and the transporter system for moving live and spent cartridges as described herein.
Figure 27B:
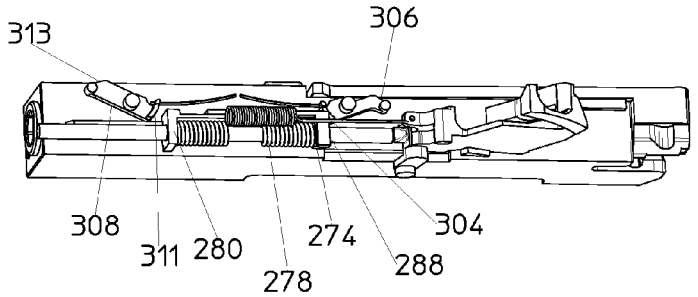
Figure 27C:
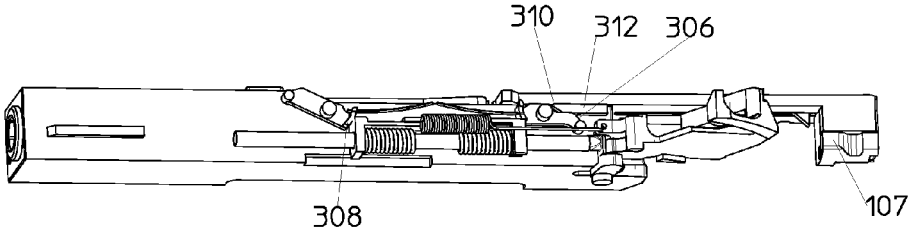

With reference to FIG. 27A-27E, the operation of the actuator assembly 264 for moving the transporter 260 is now described. When the slide assembly 36 is in the ready-to-fire position (FIG. 27A), the actuator assembly 264 is located at a home position on the barrel top surface 286. In this position, the rear stop gate 304 is urged inwardly by the spring 303 into abutment with the rod mount 274. As the slide assembly 36 recoils, the raised block 300 on the barrel surface 286 moves into contact with the front edge 298 of the spring stop to force that stop toward the rod mount 274 with sufficient energy to compress the ramrod spring 278 against the notched plate 288 on the rod mount. As the rod spring stop 290 is moved rearwardly as the barrel block 300 nears its full recoil location (27B), the spring stop bypasses the stop gate 311 so that the spring 305 acting on that stop gate is able to pivot the front stop bar 308 such the gate moves into the path of the spring stop so that once the recoil force dissipates, the ramrod spring remains (momentarily) compressed between the two stop gates 304, 311 (FIG. 27C). Accordingly, the ramrod spring 278 is compressed while the barrel returns toward the ready-to-fire position and while the bolt is latched to provide the open breech configuration mentioned earlier.

Figure 27D:
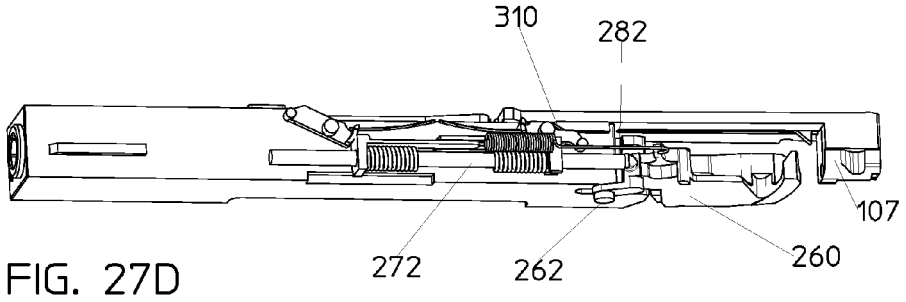
Figure 27E:
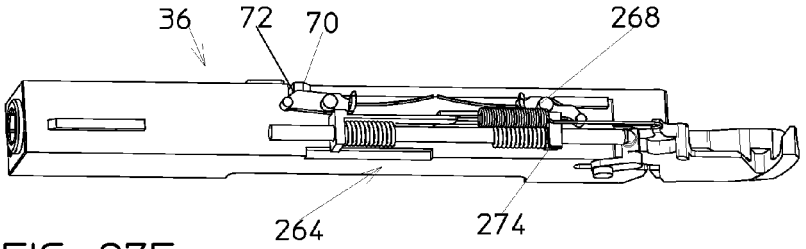

As the barrel nears the end of the travel distance back into the ready-to-fire position (27D) a tapered leading edge 310 of a feature 312 that is raised slightly above the top surface 286 of the barrel engages the tapered release tip 306 of the pivotable rear stop bar 302, which forces clockwise (FIG. 27C) rotation of that bar, overcoming the force of the spring 303 and cause the stop gate 304 to move out of the path of the rod mount 274. As a result, the energy of the compressed ramrod spring 272 forces the business end 282 of the released ramrod 272 to impel against the transporter 260 near the pivot post 262 to force the transporter 260 (with the live cartridge) to rotate into the breech position (FIG. 27D).

Figure 29A:
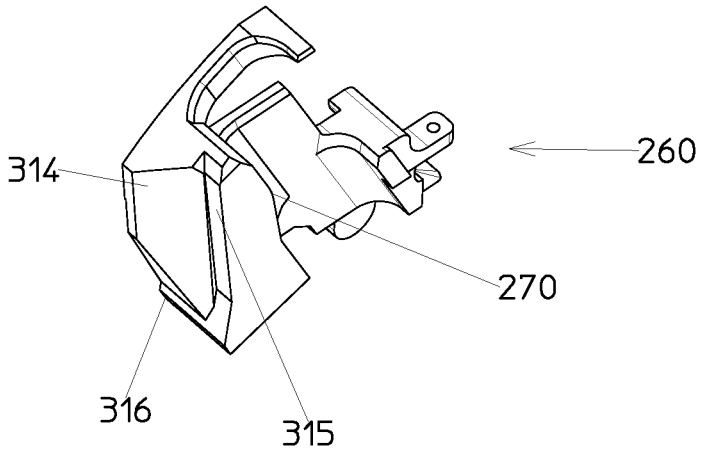
FIGS. 29A-29B are perspective, enlarged views of the transporter and latch mechanism, respectively, for securing the bolt and extracting a spent cartridge during the reloading sequence of operation of the pistol.
Figure 29B:
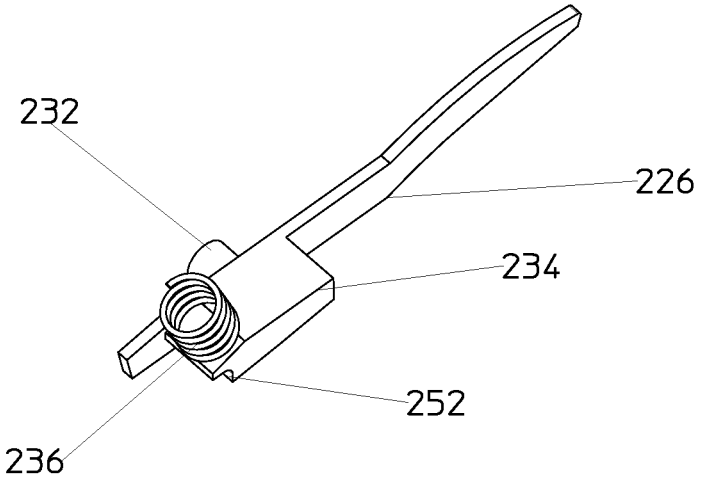

The transporter is shaped to include a wedge 314 (FIG. 29A) that extends from the underside of the carriage 270 of the transporter. The wedge 314 has a thin leading edge 316. Away from the wedge 314, the carriage underside defines an ejector surface 315. As the transporter 260 moves into the breech position (driven by the ramrod 272 as just described), the ejector surface 315 contacts the extracted shell 104 (FIG. 24B) to knock the shell loose from the extractor 254 that holds the shell rim against the breech block 86 of the bolt in the open breech position mentioned earlier.

As the transporter 260 moves closer to the breech position, (FIG. 28I) a release post 273 formed near the tab 266 of the transporter 260 is rotated into contact with the upper side of the leading end 240 of the arm 230 of the breech latch 226. This pushes the latch arm downwardly to cause the base 234 of the latch 226 to pivot upwardly by an amount sufficient to release the bolt hook 252 from the catch groove 99 that is on the breech block 86. Further rotation of the transporter 260 is stopped as the leading edge 316 strikes the frame.

At the time that the bolt hook 252 is fully released by the release post 273 on the transporter 260 to free the bolt from the latch 226, the transporter is in the breech position so that the transporter carriage 270, with the live cartridge 105 that is secured to it, is in alignment with the breech 46, and the released bolt 40 is propelled by the bolt spring 58 for chambering the live cartridge and closing the breech in the ready-to-fire position of the slide assembly 36. The bolt's breech block (FIGS. 27C and 27D) is shaped to enable the returning bolt to clear the transporter 260 while the transporter is in the breech position. Moreover, (FIGS. 12D-12I) as the leading end 62 of the bolt approaches its forward-most position against the barrel 38, the integral spring 77 encounters the protrusion 66 on the barrel, which loads the spring 77 by an amount sufficient to force slight rotation (counter clockwise in FIG. 12D) of the bolt about the disc 115, which firmly seats the bottom 90 of the breech block 86 (FIGS. 12C and 12N) in a the linear breech groove 92 of the bolt (FIGS. 12H and 26B). As the bolt seats, the wedge 259 of the extractor 254 snaps into the chamfer 93 with the pry surface 261 abutting the muzzle facing side of the rim 102 of the just-chambered cartridge.

As the bolt 40 moves toward the muzzle end of the slide assembly 36 to close the breech, the shoulder 72 on the top flange 70 of the bolt (FIG. 27E) contacts the release tip 313 of the forward stop bar 308, which tip protrudes in the path of the shoulder 72. This contact against the pivotable front stop bar 308, which forces clockwise (FIG. 27E) rotation of that bar, overcomes the force of the spring 305 and causes the stop gate 308 to move out of the path of the spring stop 290 and attached plate 293 of the actuator assembly 264 so that assembly moves back to the home position. The tension in the transporter spring 268 forces rapid rotation of the transporter 260 back to the docking position (FIG. 27A).

As the transporter is rapidly returned to the docking position, a latch reset post 275 that protrudes from the transporter 260 near the transporter leading edge 316 pushes against the underside of the leading end 240 of the arm 230 of the breech latch 226, to assist the action of the latch spring 236 in quickly moving the latch arm upwardly and returning the base 234 into position for latching the next occasion of the recoiling breech block.

Figure 24A:
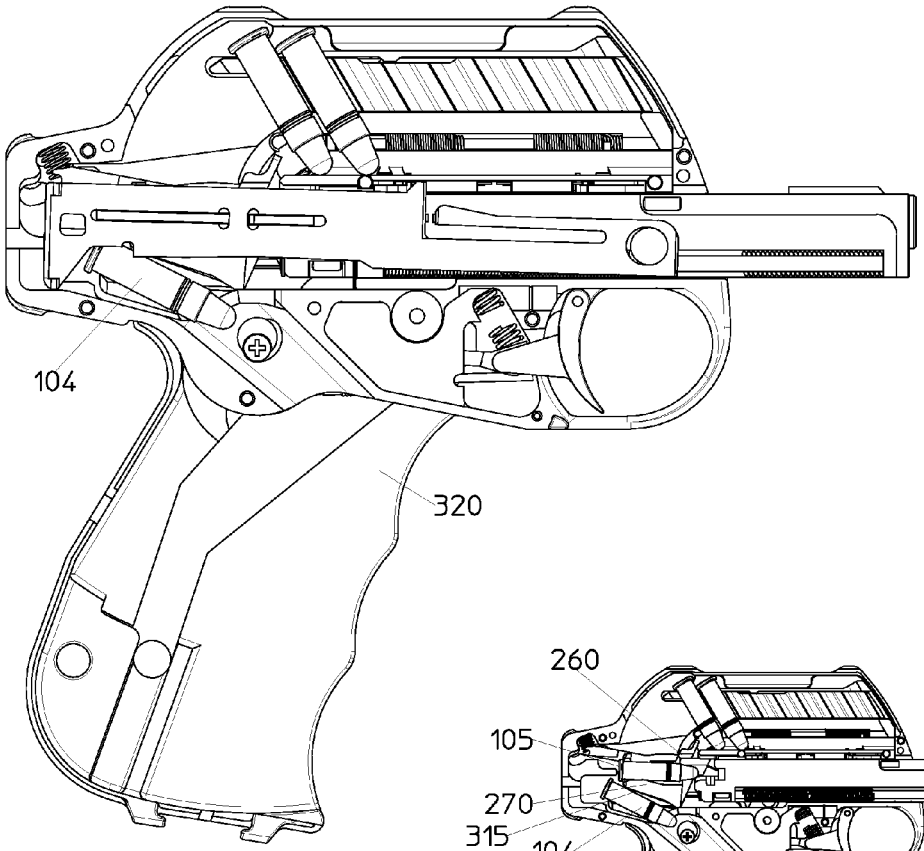
FIGS. 24A-24B are right side views of the pistol with covering removed to reveal the firing operation of the pistol, here showing a spent cartridge being expelled. The bolt component is omitted in FIG. 24B.
Figure 24B:
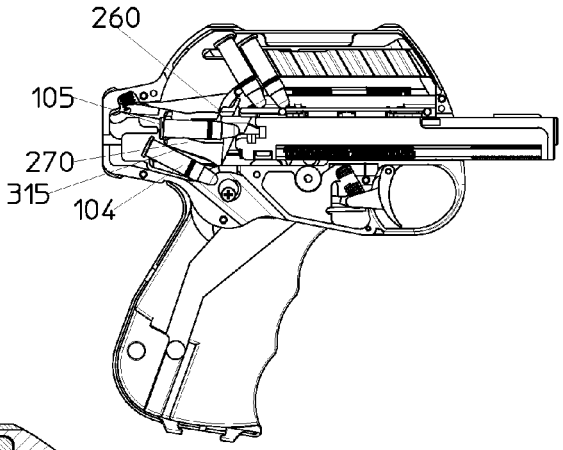
Figure 24C:
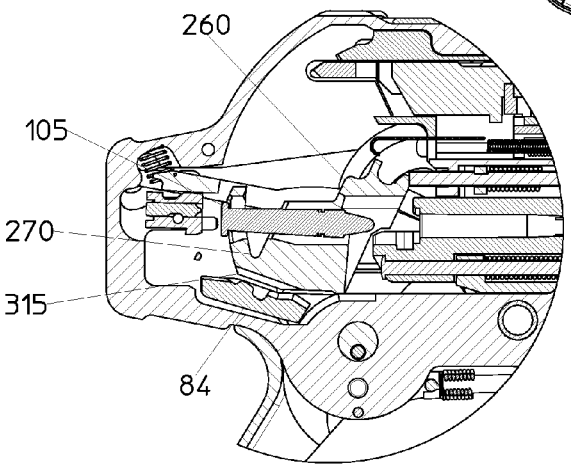
FIG. 24C is a partial sectional view, like FIG. 20C, but showing the pistol in the state illustrated in FIG. 24A.
Figure 25:
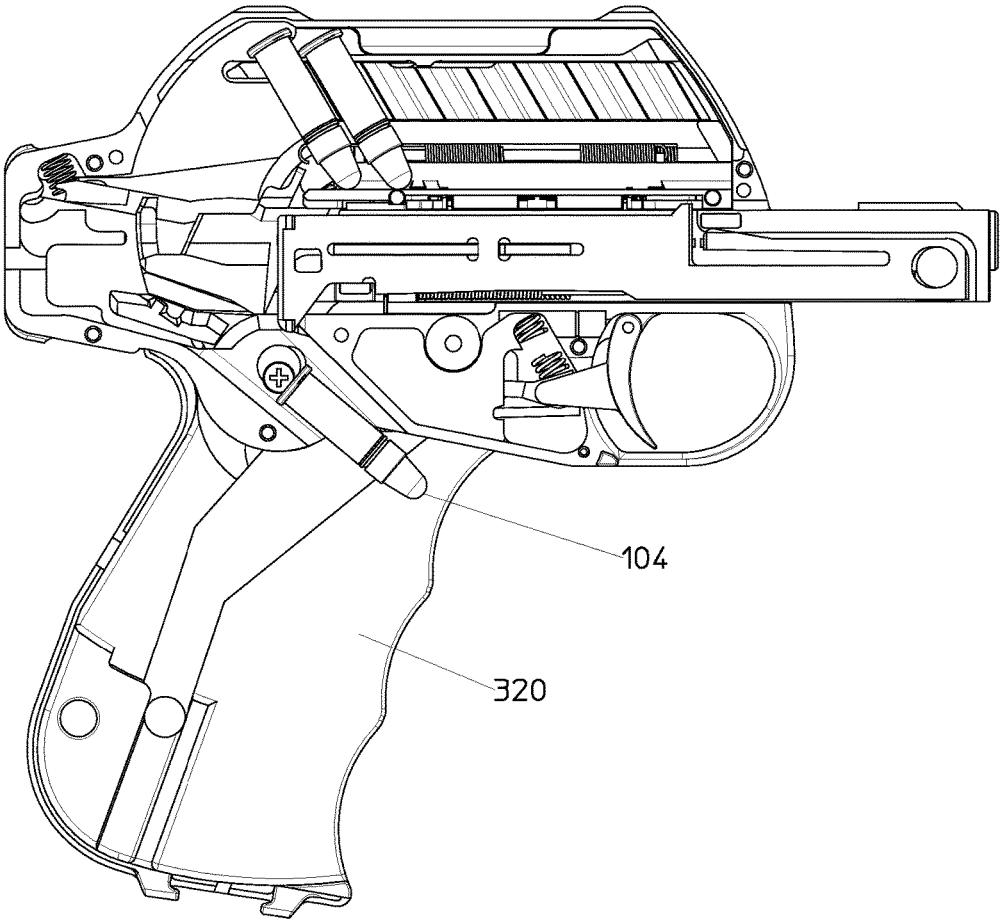
FIG. 25 is a right side view of the pistol with covering removed to reveal the operation of the pistol, here the expulsion of the cartridge into the handle cavity.

As seen best in FIGS. 24A, 24B and 25, the spent shell 104 that is knocked downwardly by the transporter 260 follows an interior path through the frame 22 and into the cavity 320 inside the handle. Accordingly, unlike many prior art approaches, the spent shells are not propelled toward the user with the attendant possibility of injury.

The above described assembly for transporting cartridges from the magazine 258 above the barrel to a position at the breech end of the barrel operates in conjunction with a side-loading feature of the magazine. This feature, among other things, significantly reduces, as compared to prior-art magazines, the amount of force required for fully loading the magazine with cartridges. Moreover, the magazine features an indexing system for precisely moving cartridges through the magazine during operation of the pistol.

Magazine

The magazine 258 (FIG. 5A) resides in the frame interior space above the slide assembly 36. Access to that space is provided by a lid 322 that is hinged at an edge 324 to the top of the frame back plate 24 (FIG. 3) and thus completes the enclosure of the frame interior when the lid 322 is closed (FIGS. 1 and 3). The hinged edge 324 of the lid (FIG. 5B includes a pair of opposed pivot pins 325 that are contained within vertical slits in the frame that thus allow, in addition to pivotal motion, slight up and down motion of the lid 322.

The closed lid 322 spans from its hinged edge 324 across the top of the frame 28 and fits within a slight recess in that part of the frame. The opposite, front side edge 330 of the lid (FIG. 5A) includes projections 326 that move downwardly to mate with the frame as the lid is closed. To open the lid 322, the user slides the lid upwardly to remove the projections from the mating relationship to the frame so that the lid is then free to swing open about the pivot pins 325 on the hinged edge 324.

Figure 8A:
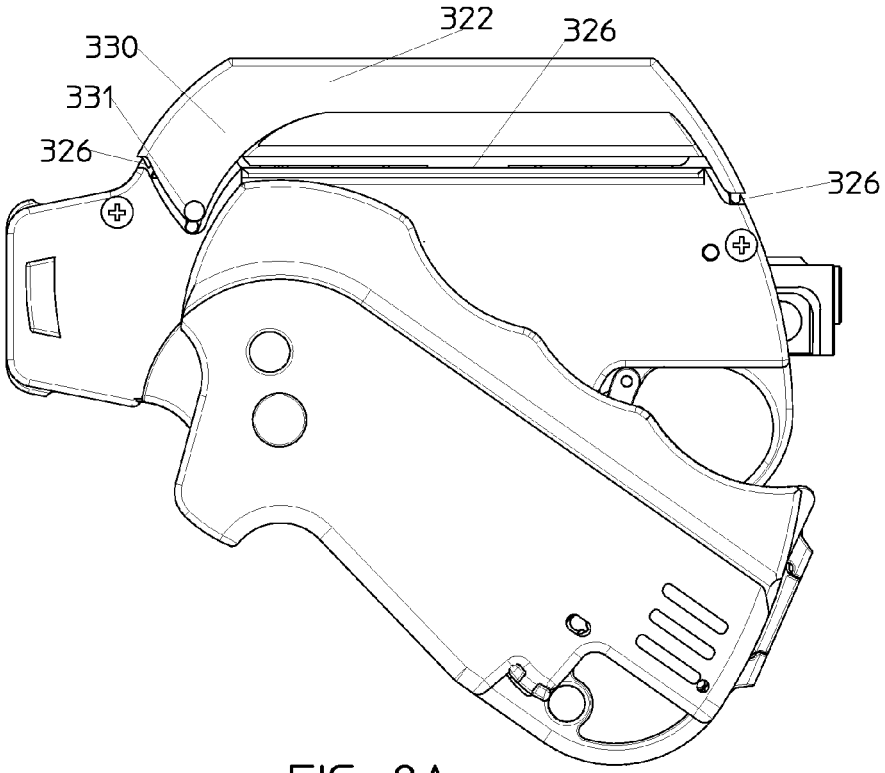
FIGS. 8A and 8B are right side views of the pistol showing the pistol in a partly open, reloading position and with the magazine lid in respective partly and completely open positions. The raised cartridge in FIG. 8B illustrates a cartridge being loaded into the magazine.

When the pistol is in the closed position (FIG. 7A) the butt 118 of the handle 116 covers a portion of the front side edge 330 of the lid. Specifically, (FIGS. 7B, 7C) at the rearward portion of the edge 330, an outwardly projecting lid pin 331 is provided on the lid 322 to be captured within a slot 333 formed partway through the interior of the right handle piece 126. The pin 331 is fully captured when the handle moves into the fully closed position (FIG. 7A) and this pin-and-slot-engagement keeps the lid 322 from sliding upwardly, thus preventing (via the frame-mating projections 326) any pivotal motion of the lid along the hinged edge 324 which would otherwise open the lid to expose the magazine contents. Thus, the closed handle safely secures the lid in the closed position. The lid can nonetheless be opened for access to the magazine interior by moving the handle slightly out of the closed position (FIG. 8A) to uncover the front side edge 330 of the lid and permit it to slide up for rotation about its hinged edge 324 and open (FIG. 8B).

The interior of the magazine 258 (FIG. 5A) includes the above-mentioned indexing system for precisely moving cartridges through the magazine during operation of the pistol. One component of this system is a ratchet 332 that is shaped to define a number of bays 334, each bay being shaped to hold a single cartridge 105. The ratchet 332 extends along the barrel, and is configured so that the bays 334 hold the cartridges 105 within the magazine in a generally vertical orientation with the rims of the cartridges above the bullet-ends of the cartridges. With the cartridge so held, the width of the magazine 258 (that is, as measured from the front to the back of the pistol) is only slightly wider than the diameter of the cartridges, thereby contributing to the overall compactness of the pistol.

Figure 8B:
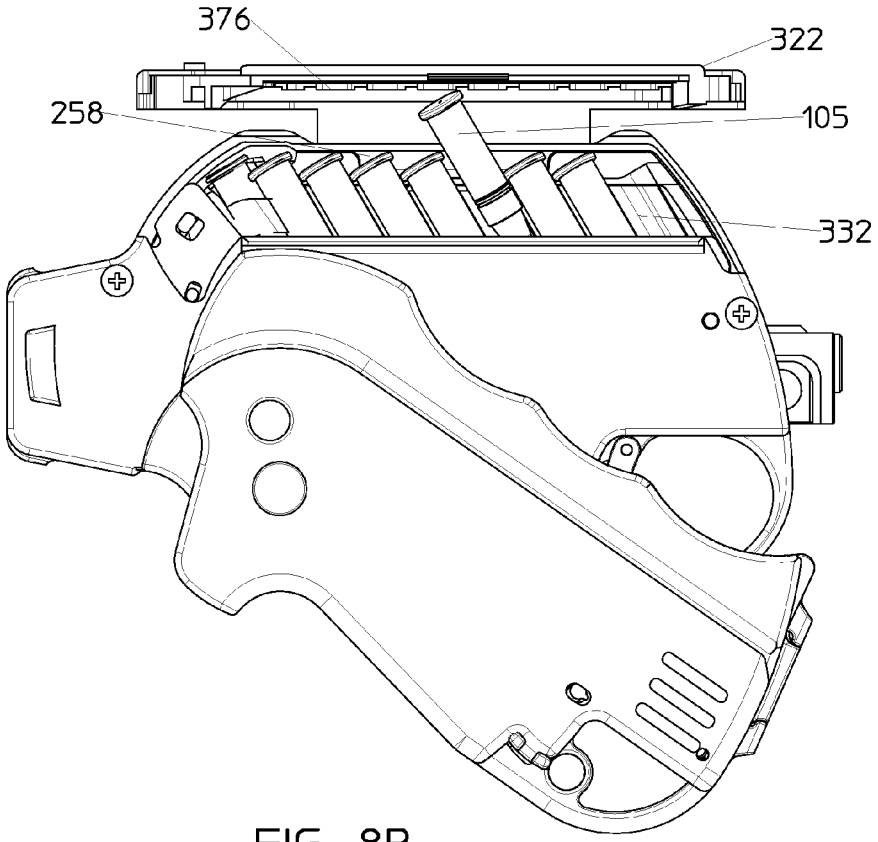
Figure 9A:
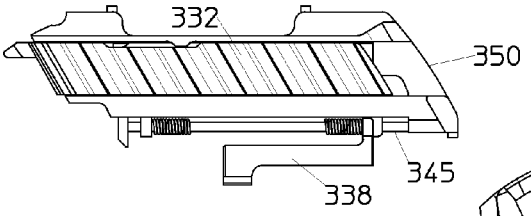
FIGS. 9A-9H are assembly views of selected internal mechanisms of the pistol that are described herein.
Figure 9B:
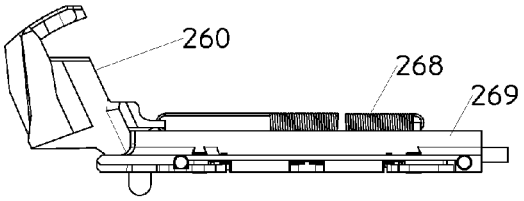
Figure 9D:
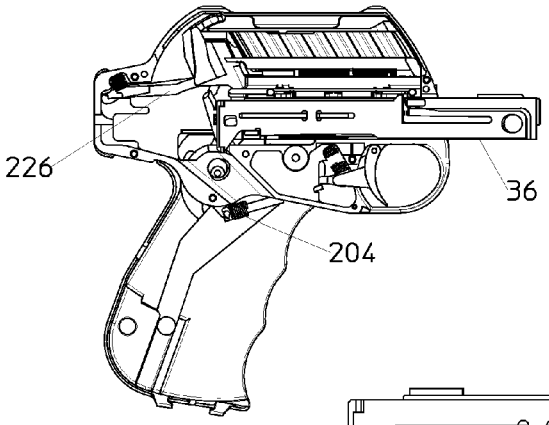
Figure 9C:
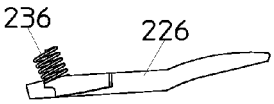
Figure 9E:
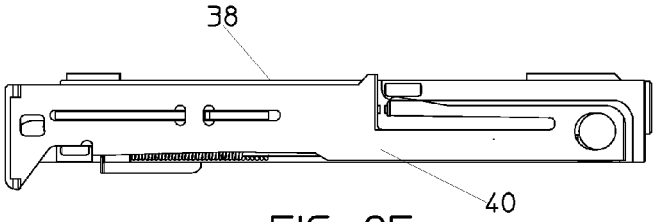
Figure 9F:
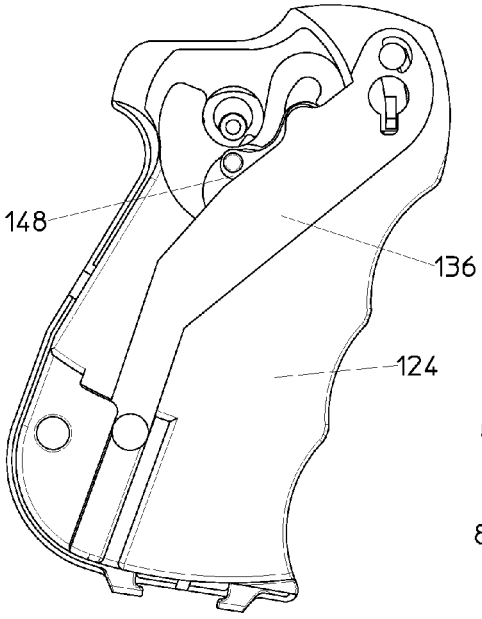
Figure 9G:
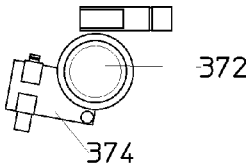
Figure 9H:
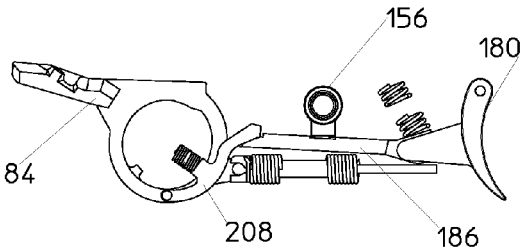

Importantly, the magazine 258 is loaded from the side (FIG. 8B). Each cartridge 105 is inserted into a bay 334 with enough manual force to slightly displace the ratchet 332 (described more below) to enable complete insertion of the cartridge into the bay. Thus, as the magazine is loaded, the force required for moving any cartridge into a bay does not increase, but remains the same, relatively small amount for each cartridge. Put another way, the side-loading technique provided here eliminates the need for progressively compressing a long magazine spring with a stack of cartridges by inserting cartridges through a single entry location as is the case with conventional magazines.

Recoil/Reaction Mass

Before turning to a description of the cartridge indexing system, it is noteworthy here that the recoil mass of the pistol is primarily in the barrel for this design. In prior art semi-automatic pistol designs the primary recoil mass in located in the breech. The design of the present invention leads to lower overall system size and mass without compromising accuracy or velocity/stopping power, which come with longer barrel lengths. Also, mounting the magazine and indexing system (discussed next) above the barrel as done in the present invention creates a reaction mass to reduce the barrel lift during recoil. This improves the accuracy of cartridges that are rapidly fired after the first. Finally, it is noted that the axis 88 of the barrel bore is low, very near the trigger pull 180. This further reduces muzzle lift upon firing.

Indexing System

The indexing system for the cartridges 105 in the magazine 258 is described with particular reference to FIGS. 14A-14H and FIGS. 28A-28I. Generally, that system includes the above-mentioned ratchet 332 that is mounted to a ratchet stay 350 for back and forth motion. The ratchet 332 mounting also permits slight lateral motion of the ratchet. For clarity in connection with the description of the indexing system, the terms "back and forth" (or, alternatively "rearward and forward") will mean general linear motion toward the breech end of the pistol and the muzzle end of the pistol respectively. Lateral or "in and out" motion is considered to be perpendicular to the back and forth motion.

A ratchet shuttle 338 comprises a generally flat plate that has a downwardly depending leg 340. The leg 340 terminates in an inwardly projecting foot 342. The shuttle slides back and forth against the inner surface of the frame back plate 24 with the innermost edge of the foot 342 slidably engaging a central groove 343 (FIG. 12A) formed in the top surface 286 of the barrel at the edge thereof. The groove 343 defines a shoulder 344 at each end of the groove.

As shown in FIGS. 14C-14G, and FIGS. 28A-28I, the ratchet shuttle 338 also includes an arm, the upper end of which terminates in a sliding block 339 (FIG. 14G) through which a shuttle rod 345 passes. The shuttle rod 345 is anchored at each end to rod brackets 349 that extend downwardly from the ratchet stay 350 fastened to the inner surface of the frame back plate 24.

An elongated ratchet drive 347 is mounted to the shuttle rod 345. The ratchet drive 347 includes a generally flat base plate 351 that has at each end downwardly extending slider plates 353 through which the shuttle rod 345 passes. The sliding block 339 of the shuttle arm is located between those two slider plates. A compressed shuttle spring 355 is also carried on the shuttle rod 345, extending between the sliding block 339 of the shuttle and the rearward (to the right in FIG. 14G) slider plate 353 of the ratchet drive. Accordingly, the shuttle spring 355 urges the shuttle 338 forwardly, toward the muzzle of the barrel 38.

The ratchet stay 350 is an elongated member mounted to extend forwardly from the vicinity of the transporter 260 adjacent to the slide assembly 36. The ratchet stay 350 extends over the base plate 351 of the ratchet drive 347 and includes a central channel 359 within which the ratchet 332 is secured. The ratchet drive 347 below the ratchet stay 350 and the ratchet 332 in the central channel 359 of the stay 350 are linked together through the ratchet stay 350. As can be seen in FIGS. 14G and 28E-28I, the base plate 351 of the ratchet drive 347 has a pair of spaced apart sockets 352 formed on the upper surface. Each socket receives a downward pivot pin extending from an outer end of a link bar 354 that is mounted to swing about the top of the socket 352.

Each of the link bars 354 extends from the sockets 352 so that the opposite, inner end of each link bar fits within a clearance notch 357 formed in the back of the ratchet 332. An upward pivot pin extending from the top of the link bar inner end is captured in an aperture (not shown) that extends upwardly from the clearance notch 357 into the body of the ratchet 332. The base plate 351, two link bars 354, and connected ratchet 332 provide a four-bar linkage for operating the linkage system as will be described.

Figure 5A:
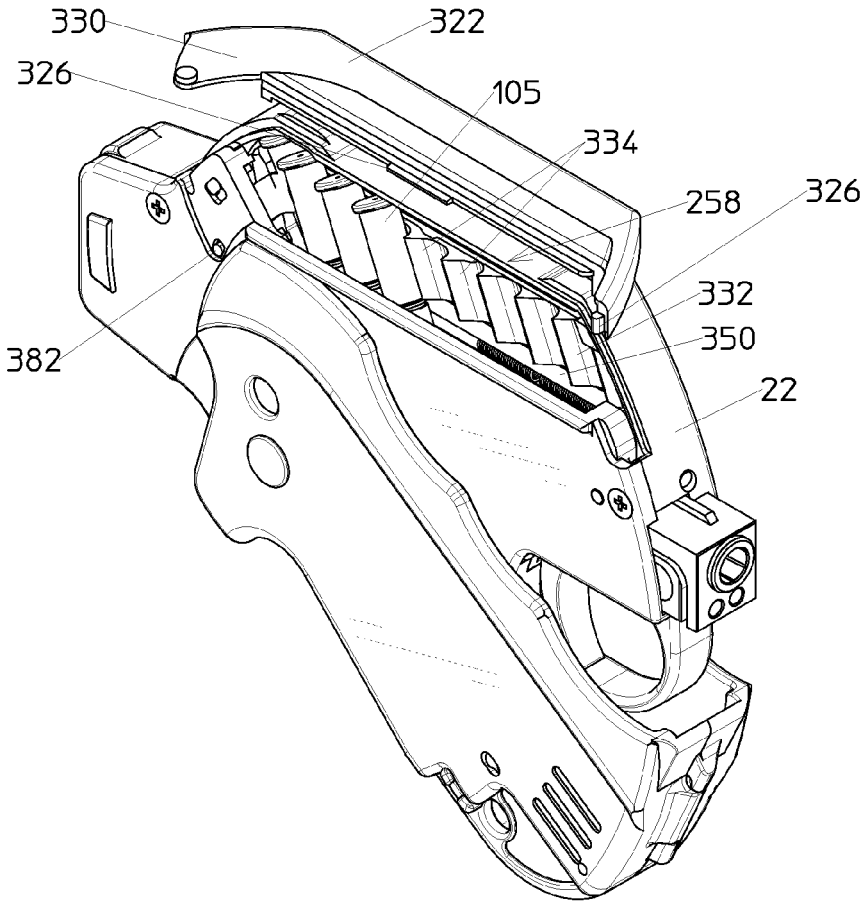
FIG. 5A is another perspective view of the pistol of FIG. 1 showing the pistol in a partly open, reloading position with the magazine lid in the open position.
Figure 14A:
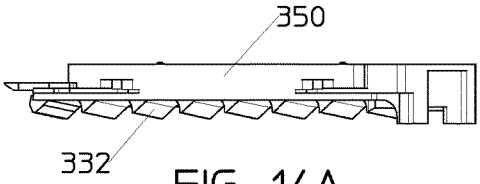
FIGS. 14A-14H are views of the indexing system for moving cartridges through the magazine during operation of the pistol.
Figure 14B:
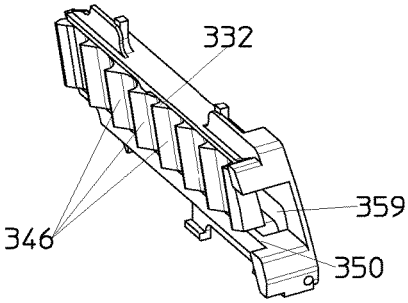
Figure 14C:
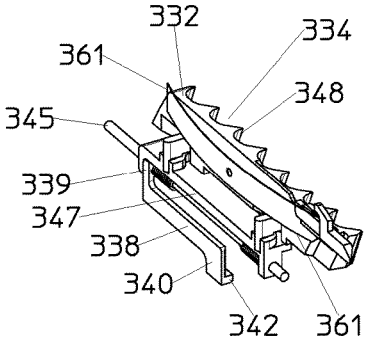
Figure 14D:
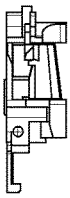
Figure 14E:
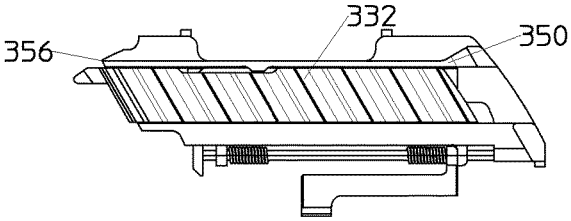
Figure 14F:
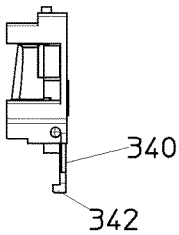
Figure 14G:
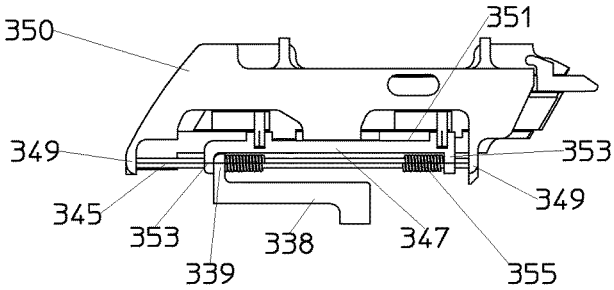
Figure 14H:
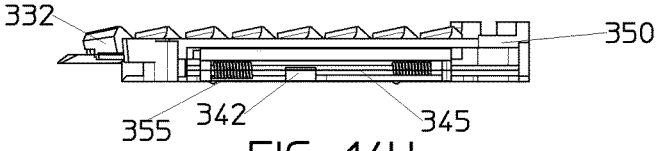

As seen in FIG. 5A and FIGS. 14B-14C, the inner facing side of the ratchet 332 includes a row of teeth 346. Each ratchet tooth has a relatively small-radius curved drive side 348 that faces left and slightly rearwardly and generally conforms to the curvature of the cartridge that is positioned against it in the bay 334. The other side of each tooth tapers gradually toward the adjacent tooth. The ratchet teeth will drive the cartridges rearwardly when the ratchet 332 is driven rearwardly to move one cartridge at a time into the carriage 270 of the transporter 260.

Figure 5B:
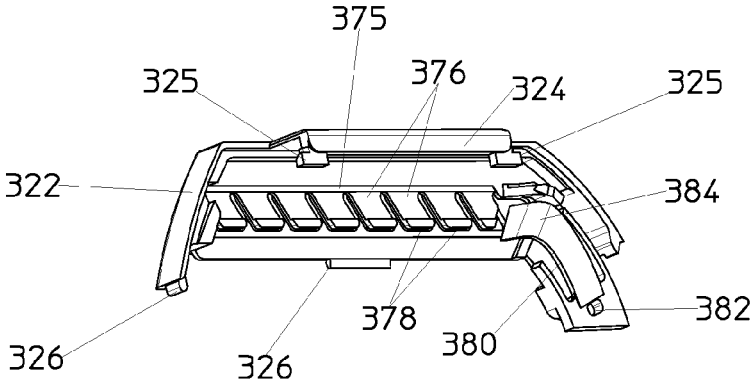
FIG. 5B is a perspective view of the magazine lid interior.
Figure 6A:
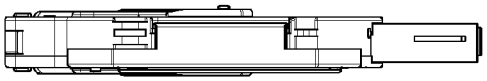
FIGS. 6A-6F are respective elevation views of the top; back; right side; front; left side; and bottom of the pistol in the open or ready-to-fire position.
Figure 6B:
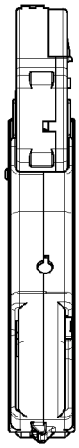
Figure 6C:
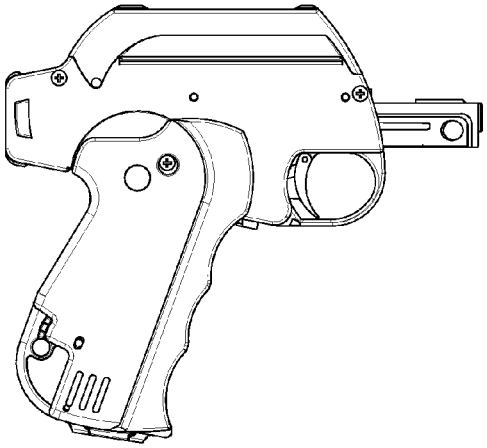
Figure 6D:
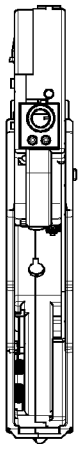
Figure 6E:
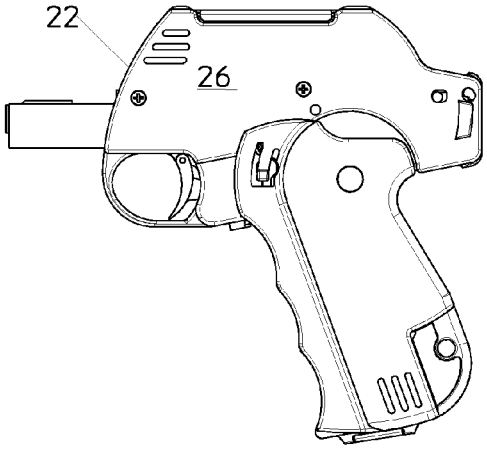
Figure 6F:
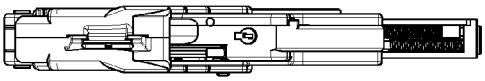

The magazine lid 322 includes spring elements for facilitating movement of cartridges 105 through the indexing system. With reference to FIGS. 5A-5B, a spring frame 375 is mounted inside portion of the lid that faces the ratchet 332 and cartridges 105 in the magazine when the lid is closed. The spring frame 375 includes an array of inwardly extending cartridge springs 376, each spring 376 generally matching the width of a bay 334 in the ratchet. The cantilevered tips 378 of the springs have rounded edges and are thickened somewhat. Those spring tips 378 protrude inwardly by an amount such that they will each resiliently contact a cartridge, should one be loaded in the bay across from the spring 376. The springs 376 ensure that the cartridges 105 remain in contact with the ratchet 332 as the index system is operated, and have sufficient resilience to remain in contact with the cartridges as the ratchet 332 is moved both laterally and back-and-forth within the magazine.

At the end of the lid adjacent to the transporter 260 a flat, curved, cantilevered carriage spring 380 is mounted to the inside of the lid (FIG. 5B). The carriage spring 380 is fixed at one end 382 to the lid interior. The other, free end of the spring 380 is curved inwardly to present a convexly curved contact end 384 extending partway into the path of a cartridge as the cartridge is moved into the carriage 270 of the transporter 260. The contact end 384 serves to resiliently alter the path of the cartridge from the rearward-most bay 334 of the ratchet and urge the cartridge into the empty carriage.

The ratchet stay 350 has a leaf spring 361 is mounted between the stay 350 and the back of the ratchet 332 in the stay central channel 359. The leaf spring 361 urges the ratchet 332 inwardly, away from the ratchet stay 350 and toward the cartridges carried in the ratchet 332, which cartridges are thus secured between the ratchet and the cartridge springs 376 in the lid 322.

Figure 28A:
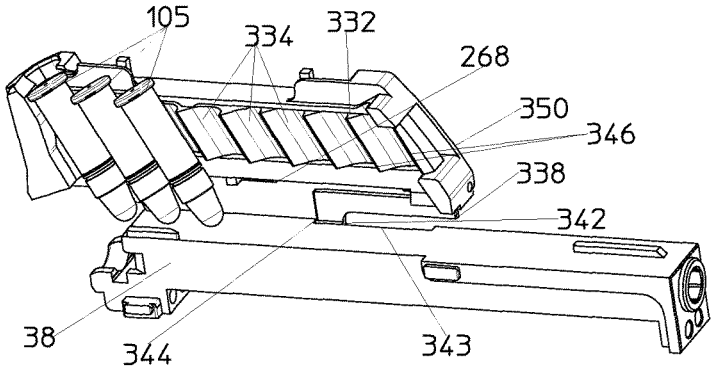
FIGS. 28A-28D are front perspective views illustrating the operative relation between the slide assembly and the indexing system for moving cartridges through the magazine.
Figure 28B:
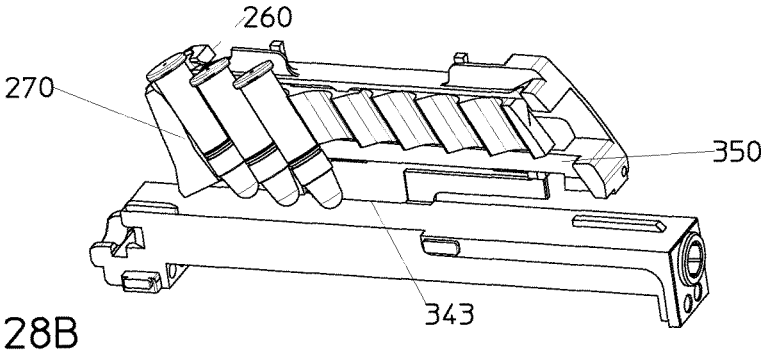
Figure 28C:
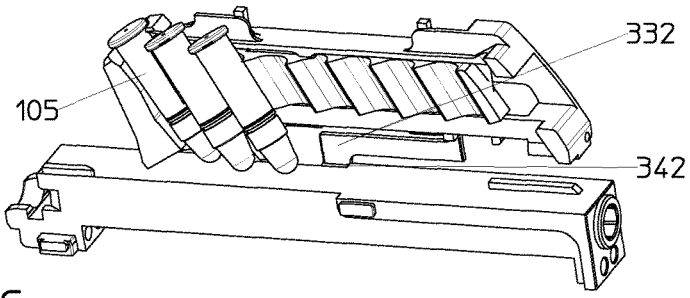
Figure 28D:
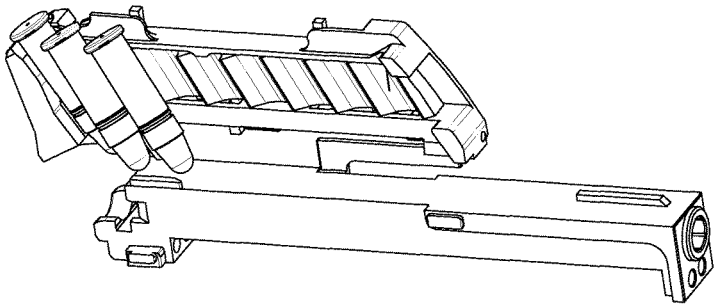
Figure 28E:
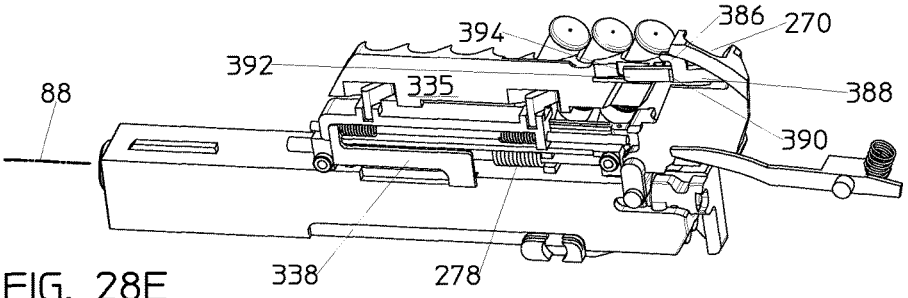
FIGS. 28E-28I are perspective views illustrating the operative relation between the slide assembly, indexing system and transporter system for moving cartridges through the magazine.
Figure 28F:
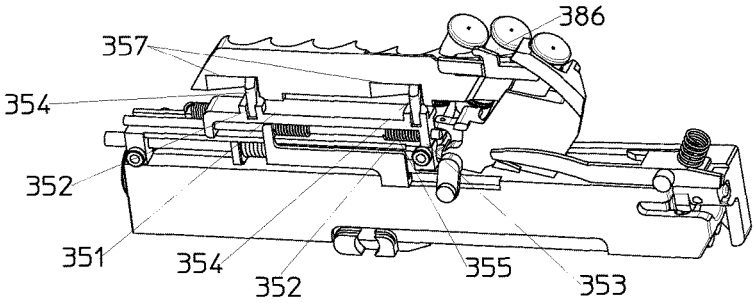
Figure 28G:
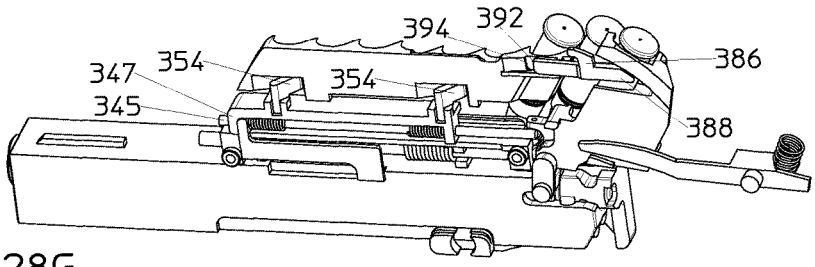
Figure 28H:
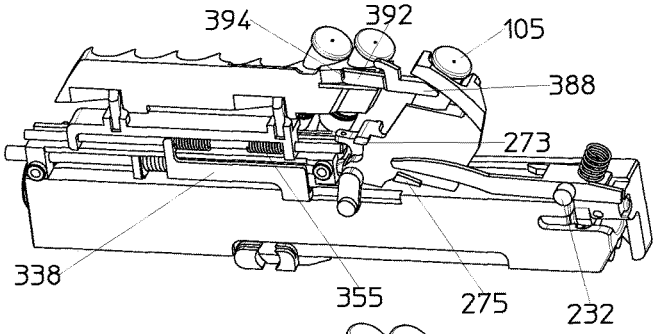
Figure 28I:
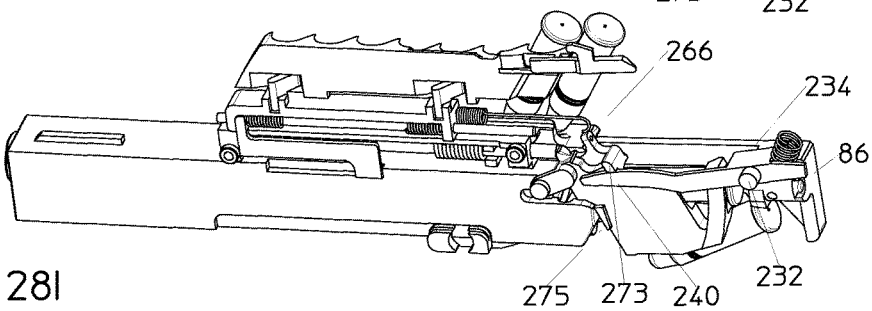

The operation of the indexing system is next described with particular reference to FIGS. 28A-28I. In FIGS. 28A and 28E, the pistol is shown in the open, ready-to-fire position with the transporter 260 in the docking position as noted earlier with no cartridge in the carriage 270. In this position, the ratchet drive 347 is in its forward-most position on the shuttle rod 345 (FIG. 28E). The barrel 38 is movable to the recoil position as a result of the user closing the pistol as described above, or as a result of the recoil force from a fired cartridge, In either event, as the barrel moves from the ready to fire to the recoil position (FIGS. 28C and 28F), the shuttle foot 342 slides through the barrel grove 343 until it encounters the forward shoulder 344 of that groove, whence the motion of the recoiling barrel is transferred to the shuttle such that the sliding block 339 of the shuttle arm moves along the shuttle rod 345 to compress the shuttle spring 355. As shown if FIGS. 28E and 28F, the compression of the shuttle spring 355 acts on the rearward slider plate 353 of the ratchet drive 347 to move that drive 347 toward the transporter 260. This motion is transferred via the bar links 354 to the ratchet. It is noteworthy that as the shuttle drive 347 is moved out of the forward-most position (FIG. 28E) the initial motion of the ratchet 332 is effected by the slight rotation of the bar links 354 to laterally extend the ratchet 332 slightly away from the ratchet stay 350 and against the cartridge spring tips 378 within the lid as discussed above. The laterally extended ratchet 332 and spring 378 arrangement provides precise and certain movement of the cartridges as the ratchet is thereafter moved rearwardly.

The rearward movement of the ratchet 332 drives the cartridges 105 in each bay rearwardly by one bay position. However, in the event, for example, that the pistol is opened and closed more than once without firing, the carriage 270 will already have a cartridge. In such an instance, the full rearward motion of the ratchet 332 is prevented by a stop so that the ratchet 332 does not attempt to force another cartridge into the carriage. The stop comprises a ratchet stop 386 (FIGS. 28E, 28F). The ratchet stop 386 is fit between an indented portion of the frame and limited to swiveling motion about a generally vertical axis through its center. A flag end 388 of the stop 386 is free to move into the carriage 270 if no cartridge is present there. This motion is biased by one end of the above described leaf spring 361 that bears on a central shoulder 390 formed in the stop 386. The end opposite the flag end 388 is a thin, flat stop end 392 that extends generally parallel to the barrel axis 88 spaced from the back surface 335 of the ratchet 332 when the flag end is biased into the empty carriage space. A stop notch 394 is formed in the part of the back surface 335 of the ratchet that is moved back and forth adjacent to the ratchet stop 386 during operation of the indexing system.

In instances where there is no cartridge in the carriage 270 of the transporter 260, the flag end 388 of the ratchet stop will be urged into that carriage space and, consequently, the stop end 392 will remain spaced from the ratchet back surface 355. Consequently, the ratchet 332, the stop notch 394 in particular, is free to move rearwardly past the stop end 392 as occurs in the motion illustrated in FIGS. 28E-28F. On the other hand, as can be seen in FIGS. 28G and 28H, if the carriage 270 already carries a cartridge as the recoil motion of the barrel occurs, the presence of the cartridge 105 in the carriage will prevent the spring-biased flag end 388 of the stop 386 from swiveling into that space. Consequently, the stop end 392 is pushed by the spring 361 to swivel into the path of the stop notch 394 in the ratchet 332. As seen in FIG. 28H when the notch 394 and stop end 392 engage, further, possibly jamming motion of the ratchet 332 toward the transporter is stopped, although the recoiling motion of the shuttle 338 with the barrel continues because the shuttle spring 355 is configured to continue compression should the ratchet be stopped as just described.

Returning to the description of the indexing system (that is, assuming the ratchet stop 386 is not flagged to prevent full rearward motion of the shuttle 332). The rearward movement of the ratchet 332 directs the rearward-most cartridge into the carriage 270 of the transporter 260 while the transporter is in the docking position. As shown in FIG. 15A-15B, the carriage 270 has a bed 358 that faces and receives the cartridge. Spaced away from the bed 358 is a finger 360 that protrudes forwardly partly over the carriage bed. In a preferred embodiment, the rearward end of the ratchet stay 350 includes a clearance cutout 356 (FIG. 14E) into which moves the carriage finger 360 when the transporter 260 moves into the docking position. As best seen in FIG. 28C, the rearward-most cartridge 105 is directed by the ratchet 332 and by the above mentioned contact end 384 of the carriage spring (FIG. 5B to move outwardly slightly into the bed 358 of the carriage and so that the finger 360 will contact the cartridge to secure it in the carriage 270 as the carriage rotates with the cartridge into the breech position (see FIG. 24B) after the barrel has returned to the forward position and while the breech is latched open as discussed above.

As the barrel 38 returns to the ready-to-fire position (FIG. 28D) the ratchet 332 advances forwardly by one index position. During this time, the link bars 354 on the back of the ratchet 332 are pulled by the shuttle to rotate by an amount that enables the ratchet teeth 346 to retract slightly toward the ratchet stay 350 so that the forward force of the teeth 346 against the cartridges 105 is overcome by the frictional contact between the cartridges and the spring tips 378 to prevent the cartridges from moving forward with the forward motion of the ratchet 332. As a result, the cartridges slip over the teeth and shift into bays 334 that are one-more rearward from the bays in which the cartridges had just occupied.

Manual Cycling

Considering the foregoing portions of this detailed description, it will be appreciated that the manual cycling of the pistol to open it so that a cartridge is chambered in the empty breech is much easier than with past approaches, primarily because there is no need to operate (compress) a stiff main spring in order to move the slide assembly for chambering a cartridge. Also, the manual removal of a chambered live round from the chamber (and, if desired for emptying the remaining cartridges in the magazine) is relatively easy because moving the slide assembly manually toward the full recoil position is assisted by the mechanical advantage provided by the above-described linkage system between the handle and frame that moves the pistol into and out of the open position.

Electronics

Figure 19A:
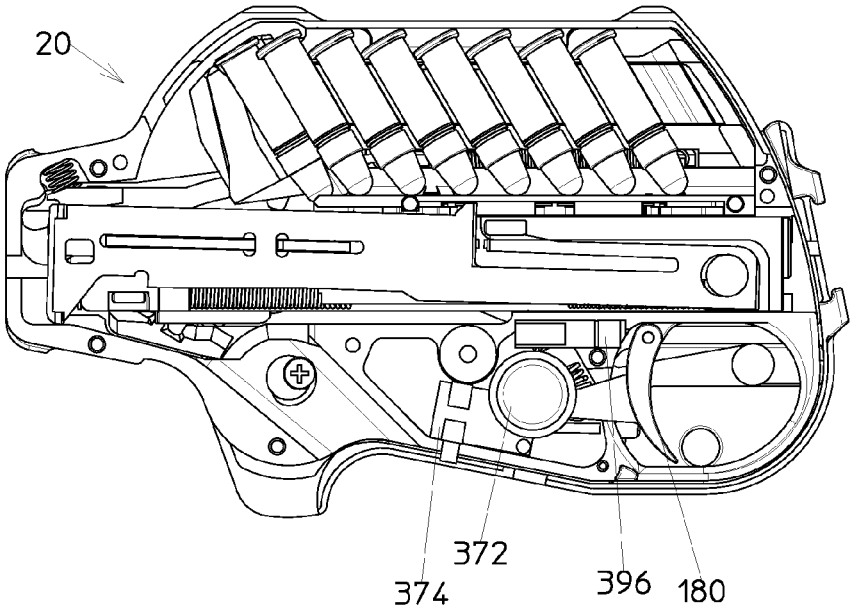
FIG. 19A-19B are views of the closed pistol revealing the interior portion of the pistol wherein electronic components are mounted.
Figure 19B:
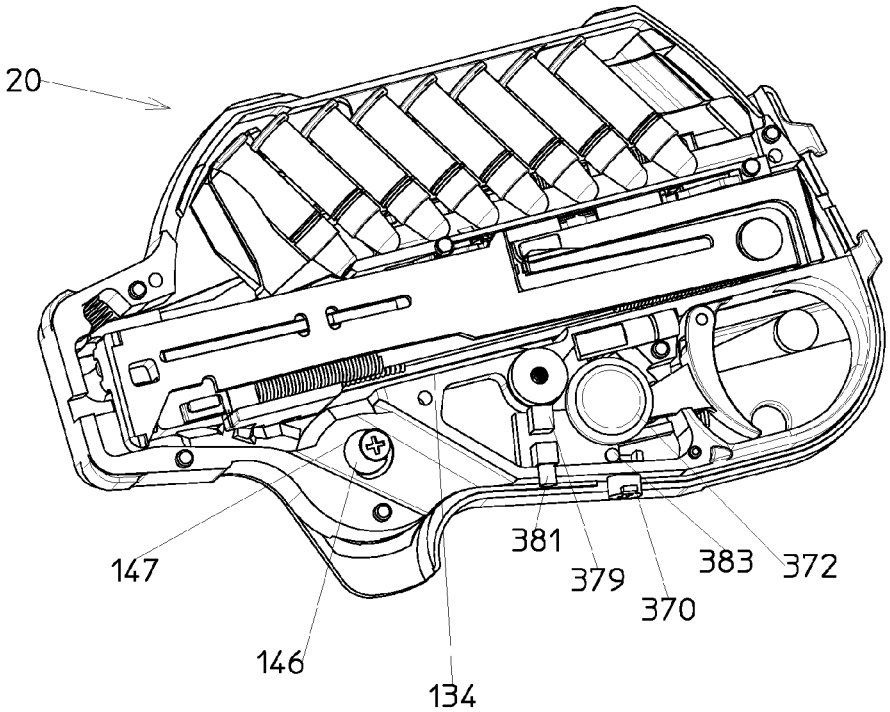
Figure 31:
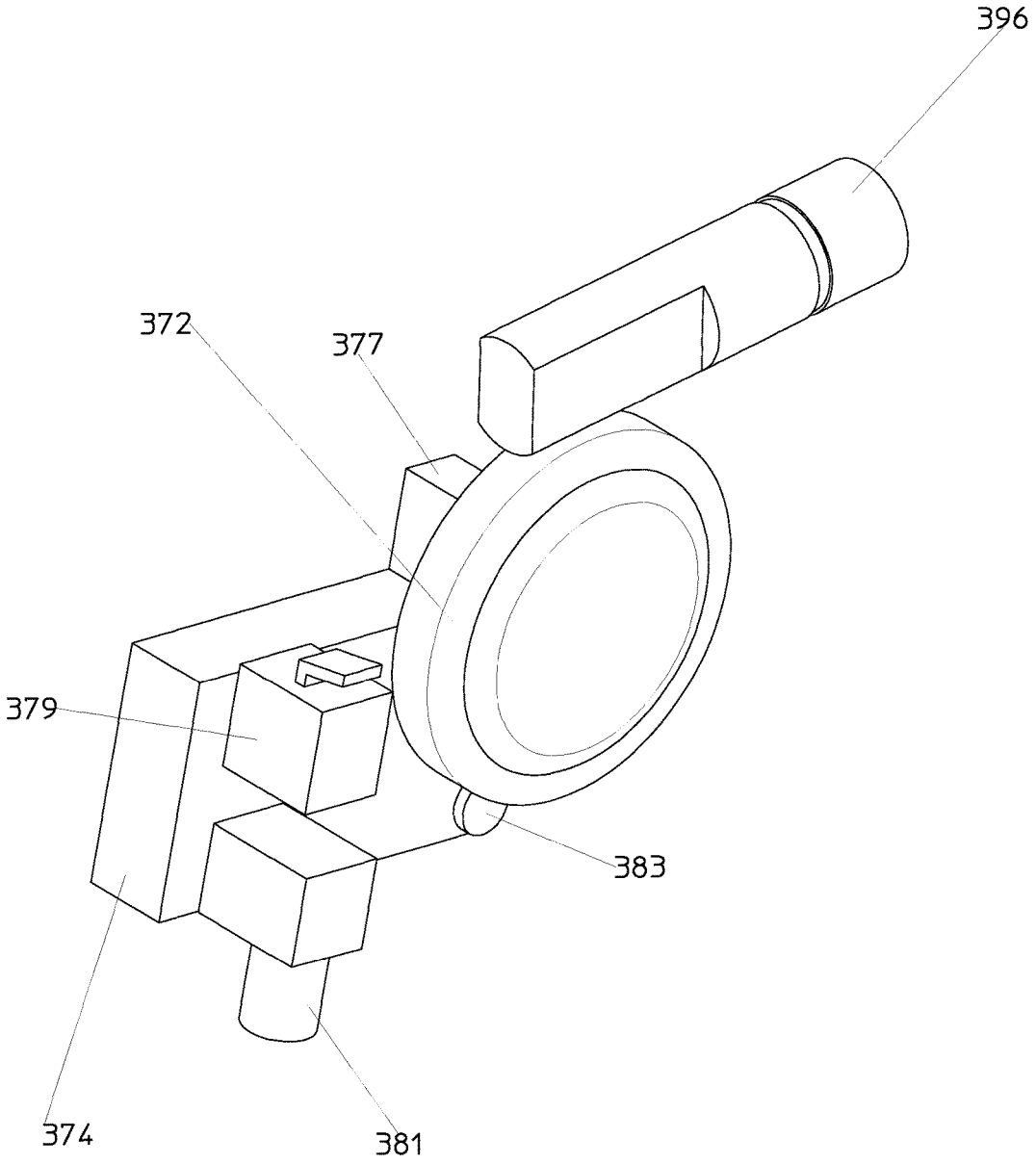
FIG. 31 is a perspective view of electronic components that may be carried by the pistol.
Figure 32A:
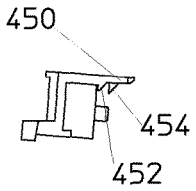
FIGS. 32A-32I are views of an alternative embodiment of a breech latch mechanism for securing the bolt and extracting a spent cartridge during the automatic reloading sequence of operation of the pistol.
Figure 32B:
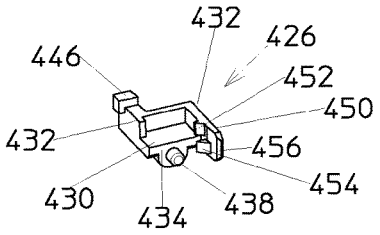
Figure 32C:
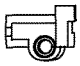
Figure 32D:
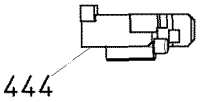
Figure 32E:
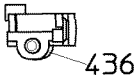
Figure 32F:
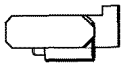
Figure 32G:
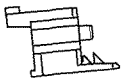
Figure 32H:
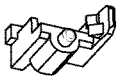
Figure 32I:
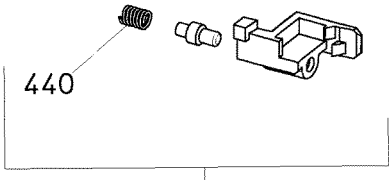

With reference to FIGS. 19A-19B and 31, the frame of the pistol is configured to incorporate electronics in the form of a battery 372, and an electronics board 374 comprising a central processing unit, a low-energy wireless transmission module, such as one employing Bluetooth technology, an accelerometer, and connected switches. Preferably, the electronics are generally housed in a small compartment behind the trigger pull 180. Microswitches are included for detecting instances: when the pistol cover is opened (switch 381); when the handle is latched with the pistol in the ready-to-fire state (switch 379); when the trigger is pulled (switch 377); and when the trigger assembly is in a locked state (switch 383). In response, the electronics board (sealed module) 374 is configured to transmit state information corresponding to the switch signals to a remote device such as a smartphone to alert the user or others accordingly. This may be used by a smartphone application to alert authorities for the need of help, without having to access the other device. It is also contemplated that the electronics directly, or through remote control, communicate with small solenoids included in the frame for disabling operation of the pistol, such as by driving the above noted lock 370 into a locked state. For example, if the pistol is taken from the user, the user may be able to disable it with a smart phone application The battery 372 also powers a small laser light emitter 396 that is secured in a compartment behind and beside the trigger pull 180 for propagating a laser-beam for sighting purposes. Additionally, the upper part of the frame is configured to include conventional rear and front sights.

As one alternative embodiment, it is contemplated that functions of the earlier described embodiments of the breech latch, extractor and manual latch override can be integrated in an alternative embodiment of a breech latch (with some modifications to the frame and bolt) as described next:

Alternative Breech Latch

Figure 33:
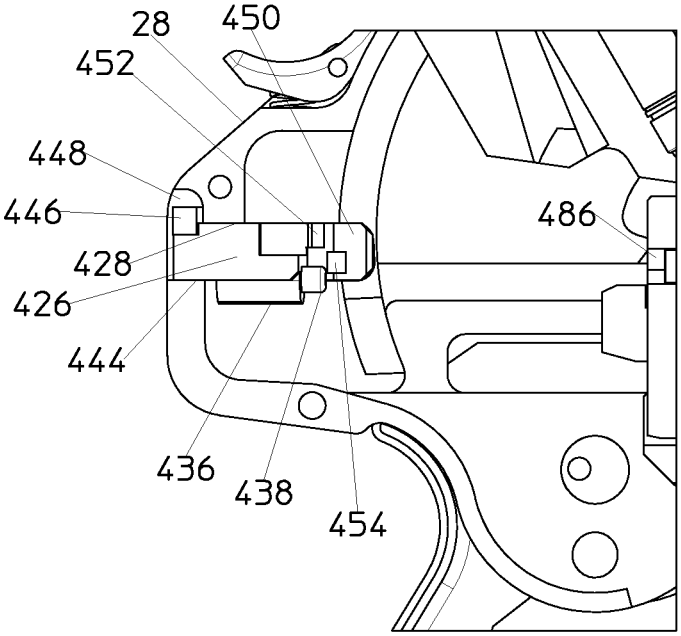
FIG. 33 is an enlarged detail, side view of the pistol interior showing an alternative embodiment of a breech latch mechanism.

The alternative breech latch 426 (FIGS. 32A-32I) is attached to the rear of the frame (at the left side of the frame as viewed in FIG. 33) opposite to and aligned with the muzzle aperture 34. In this region, the frame is thickened near the sidewall. A notch 428 having opposing flat, parallel surfaces is formed in this thickened part of the frame. The latch 426 has a generally rectangular tray-like shape including a base 430 up from which project thin sidewalls 432 along a portion of its periphery as seen in FIGS. 32A-32H. The base 430 includes a generally vertical contact face 434 against which firmly abuts the fully recoiled breech block 486 of the bolt. The base 430 is formed to include a plunger that is secured within a cylinder 436 formed in the base underside. The tip 438 of the plunger protrudes outwardly from the contact face 434 and is normally secured in that position by a resilient compression bushing or spring 440 (FIG. 33I) contained within the cylinder 436 to urge the plunger tip outwardly. The tip 438 of the plunger is located to be in the path of at least part of the shell of a chambered cartridge and plays a role in initially loading and emptying cartridges as will be explained.

A breech block 486 for use with this embodiment would be configured similar to that breech block 86 described above, except the catch groove 99 is replaced with a protruding edge that is aligned to be hooked by the bolt hook 452 described below. The exposed rim 102 in the breech is aligned with the shell hook 454, also described below.

The upper edges of the sidewalls 432 of the latch 426 are flat and parallel to the flat part 444 of the base underside of the latch 426 that is nearest the frame sidewall 28. A mounting block 446 is formed to extend upwardly from an upper, rear corner (FIG. 33 and FIG. 32B) of the latch 426. The mounting block 446 is captured in a recess 448, which is an upward extension of the rearward end of the notch 428.

With the mounting block 446 in the recess 448, the remainder of the latch extends through the notch 428 to project forwardly with the flat part 444 of the latch base and the flat edges of the sidewalls respectively abutting the facing flat surfaces of the notch 428. The mounting block 446 is tapered somewhat and the recess 448 within which it is captured is slightly larger than the block. As a result, the mounting block is able to pivot slightly from side to side about a vertical axis passing through the block such that the remainder of the latch 426 is able to shift slightly from side to side across the flat surfaces of the notch.

The pivoting or shifting motion provided by the mounting arrangement of the latch 426 as just described enables the latch 426 to catch and subsequently release both the recoiled bolt and the rim of the spent, chambered cartridge. In this regard, the bolt of this embodiment does not carry an extractor, such as extractor 254 described above. In this alternative embodiment, one of the peripheral sidewalls of the latch 426 protrudes forwardly, toward the muzzle, to define a hook plate 450. The hook plate 450 carries two separate hooks, a bolt hook 452 and a shell hook 454. The leading edge 456 of the hook plate 450 is tapered. As the recoiling breech block 486 of the bolt approaches and contacts that leading edge 456, the hook plate 450 is pushed out of the path of the bolt and thus acts as a lever to cause the latch 426 to pivot slightly about the mounting block as noted earlier. For reference, this pivotal motion of the latch 426 such that the hook plate 450 is moved away from the recoiling bolt will be called the "outward pivot motion," and the next-discussed opposite motion of the hook plate moving toward the bolt with be referred to as the "inward pivot motion."

Figure 34:
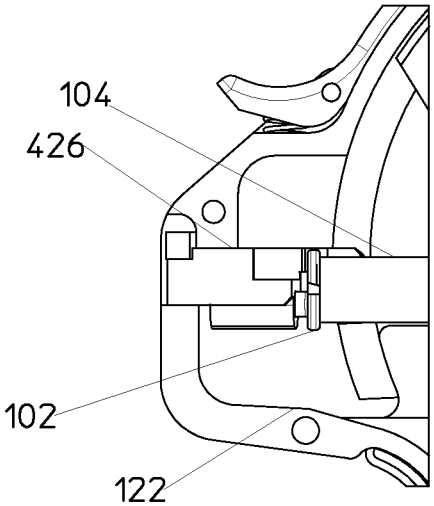
FIG. 34 is another enlarged detail, side view of the pistol interior showing the alternative embodiment of a breech latch mechanism.

As the breech block 486 continues toward the contact face 434 of the latch base 430, it abuts that face while the exposed portion of the spent cartridge rim bears against the plunger tip 438. The force of these recoiling components against the latch contact face 434 and plunger pushes the latch 426 through the inward pivot motion, and the hooks carried on the hook plate 450 are arranged so that the inward pivot motion results in the bolt hook 452 engaging a protruding edge on the breech block 486 of the bolt while the shell hook 454 engages the rim 102 of the spent cartridge 104 in the chamber (FIG. 34). Upon the dissipation of the recoil force, the compressed bolt spring 58 pulls the bolt forward but the bolt hook 452 and protruding edge on the breech block 486 remain engaged (that is, with the recoiled bolt hooked in place by the latch 426) until that hook is later released as explained below.

As noted above, as the compressed main spring 56 expands to force the barrel 38 fully forward after the recoil force dissipates. As a result, the barrel is not latched in the recoil state and as the barrel returns to the ready-to-fire position, the spent cartridge 104 is extracted from the breech 46 because its rim 102 is hooked by the latch 426 as described above.

During the brief time period that the pistol is in the open breech state described above, the spent, extracted shell 104 is expelled and a live cartridge 105 is delivered from a magazine 258 above the pistol barrel into alignment with the breech before the bolt is released and propelled by the bolt spring for chambering the live cartridge and closing the breech in the ready-to-fire position. Much of this action performed on the cartridges is effected by a transporter 260 as described above. In this embodiment, the transporter 260 moves into the breech position (driven by the ramrod 272 as described above), and contacts the extracted shell 104 (FIG. 34) to knock the shell loose from the shell hook 454 that secures it to the latch 426. As the transporter 260 moves closer to the breech position as described above it bears against the leading edge 456 of the hook plate 450 on the latch 426 and pushes the hook plate outwardly to cause the latch 426 to pivot outwardly by an amount sufficient to release the bolt hook 452 from the breech block 486.

At the time that the bolt hook 452 is fully released by the transporter 260 to free the bolt from the latch 426, the transporter is in the breech position so that the carriage 270, with the live cartridge 105 that is secured to it, is in alignment with the breech 46, and the released bolt is propelled by the bolt spring 58 for chambering the live cartridge and closing the breech in the ready-to-fire position of the slide assembly 36.

As noted above, the manual cycling of the pistol to open it so that a cartridge is chambered in the empty breech is much easier than with past approaches, primarily because there is no need to operate (compress) a stiff main spring in order to move the slide assembly for chambering a cartridge. Also, the forgoing description of this alternative embodiment referred to the plunger that is secured to the latch 426 with the tip 438 of the plunger protruding outwardly from the contact face 434 of the latch. The tip 438 of the plunger is located so that it will contact the rim of a cartridge should there be one in the breech as the breech block is brought manually into the recoil position. This contact will impede further manual movement of the slide assembly for completely opening the breech. This feature serves as a tactile indicator for the user that the chamber already contains a cartridge and an attempt to load a cartridge based on the erroneous assumption that the breech is empty may be abandoned. On the other hand, if it is the user's is intent to unload a live round, the force required for pushing against the plunger tip 438 can be overridden by the user by increasing the leveraged opening force and depressing the plunger so the path to an open breech (and subsequent ejection of a live cartridge.

While the foregoing description was made in the context of preferred embodiments, it is contemplated that modifications to those embodiments may be made without departure from the invention as claimed.

The invention claimed is:

1. A collapsible pistol, comprising:

a frame;

a barrel assembly mounted to the frame and movable relative to the frame between first and second positions;

a handle, pivotally mounted to the frame to move between an open position and a closed position; and a linkage interconnected between the handle and the barrel assembly so that pivotal motion of the handle from the open position to the closed position moves the barrel assembly relative to the frame to retract into the second position, and motion of the handle from the closed position to the open position moves the barrel assembly into the first position to partly extend from the frame.

2. The pistol of claim 1 wherein the linkage is further configured so that movement of the handle from the open position to the closed position encloses the barrel assembly within the frame and handle.

3. A collapsible pistol, comprising:

a frame;

a barrel assembly mounted to the frame and movable relative to the frame between first and second positions, the barrel assembly including a barrel having a barrel bore and bolt mounted for movement relative to the barrel;

a handle, pivotally mounted to the frame to move between an open position and a closed position; and a linkage interconnected between the handle and the barrel assembly so that pivotal motion of the handle is transferred to move the barrel assembly relative to the frame;

magazine in the frame for holding cartridges; and a transporter system mounted to the pistol for actuation in response to movement of the barrel assembly and including a transporter to move a cartridge from the magazine into substantial alignment with the barrel bore.

4. The pistol of claim 3 including a latch for temporarily latching the bolt in the second position as the handle moves from the closed to the open position, thereby to define an open breech state for enabling the cartridge to move into substantial alignment with the barrel bore.

5. The pistol of claim 4 including a spring for biasing the bolt to move toward the first position, the transporter system including a latch interface for contacting and releasing the latch once the cartridge is moved into substantial alignment with the barrel bore, thereby to enable the spring-biased bolt to move to the first position and chamber the cartridge in the barrel bore.

6. The pistol of claim 3 further comprising:

a firing mechanism responsive to a trigger pull for firing a cartridge that is chambered in the barrel bore; and an interlock connected to the frame and movable into a handle lock position to lock the handle in the open position, the interlock also being movable out of the handle lock position to disable operation of the firing mechanism and to unlock the handle for movement out of the open position.

7. The pistol of claim 1 wherein the barrel assembly includes a barrel out of which may be fired a cartridge, and wherein the barrel assembly is movable to retract into the second position within the frame by a recoil force attributable to the cartridge when fired or by a user's manual movement of the handle from the open to the closed position.

8. The pistol of claim 2 wherein the linkage includes a lost motion mechanism that delays motion of the barrel assembly out of the second position as the handle is moved into the open position.

* * * * *